US009493855B2

(12) United States Patent
Branagan et al.

(10) Patent No.: US 9,493,855 B2
(45) **Date of Patent: *Nov. 15, 2016**

(54) CLASS OF WARM FORMING ADVANCED HIGH STRENGTH STEEL

(71) Applicant: The NanoSteel Company, Inc., Providence, RI (US)

(72) Inventors: Daniel James Branagan, Idaho Falls, ID (US); Jason K. Walleser, Idaho Falls, ID (US); Brian E. Meacham, Idaho Falls, ID (US); Alla V. Sergueeva, Idaho Falls, ID (US); Craig S. Parsons, Lake Orion, MI (US)

(73) Assignee: The NanoSteel Company, Inc., Providence, RI (US)

( * ) Notice: Subject to any disclaimer, the term of this patent is extended or adjusted under 35 U.S.C. 154(b) by 33 days.

This patent is subject to a terminal disclaimer.

(21) Appl. No.: 14/188,567

(22) Filed: Feb. 24, 2014

(65) Prior Publication Data

US 2014/0238556 A1 Aug. 28, 2014

Related U.S. Application Data

(60) Provisional application No. 61/768,131, filed on Feb. 22, 2013.

(51) Int. Cl.

| | |
|---|---|
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |

(52) U.S. Cl.

CPC ..... *C21D 8/005* (2013.01); *C22C 38/004* (2013.01); *C22C 38/02* (2013.01); *C22C 38/04* (2013.01); *C22C 38/08* (2013.01)

(58) Field of Classification Search

CPC ..... C21D 8/00; C21D 8/005; C23C 38/004; C23C 38/02; C23C 38/04; C23C 38/08

See application file for complete search history.

(56) References Cited

U.S. PATENT DOCUMENTS 4,439,236 A 3/1984 Ray
4,710,345 A 12/1987 Doi et al.

(Continued)

FOREIGN PATENT DOCUMENTS

WO 2012162074 11/2012

OTHER PUBLICATIONS

Sawa et al., JP Pub. No. 02077555 A, published Mar. 16, 1990, machine translation.*

(Continued)

*Primary Examiner* — Jessee Roe
*Assistant Examiner* — John Hevey
(74) *Attorney, Agent, or Firm* — Grossman, Tucker, Perreault & Pfleger, PLLC

(57) ABSTRACT

Metallic alloys are disclosed containing Fe at 48.0 to 81.0 atomic percent, B at 2.0 to 8.0 atomic percent, Si at 4.0 to 14.0 atomic percent, and at least one or more of Cu, Mn or Ni, wherein the Cu is present at 0.1 to 6.0 atomic percent, Mn is present at 0.1 to 21.0 atomic percent and Ni is present at 0.1 to 16.0 atomic percent. The alloys may be heated at temperatures of 200° C. to 850° C. for a time period of up to 1 hour and upon cooling there is no eutectoid transformation. The alloys may then be formed into a selected shape.

12 Claims, 14 Drawing Sheets

(56) References Cited

U.S. PATENT DOCUMENTS

| | | | | |
|---|---|---|---|---|
| 5,545,269 | A | 8/1996 | Koo et al. | |
| 7,618,499 | B2 * | 11/2009 | Johnson | C22C 45/02 148/321 |
| 8,257,512 | B1 * | 9/2012 | Branagan | C21D 8/02 148/325 |
| 8,419,869 | B1 | 4/2013 | Branagan et al. | |
| 8,641,840 | B2 * | 2/2014 | Branagan | C21D 7/00 148/540 |
| 9,074,273 | B2 * | 7/2015 | Branagan | C22C 38/58 |
| 2013/0119334 | A1 | 5/2013 | Bishop | |
| 2014/0190594 | A1 * | 7/2014 | Branagan | C22C 38/58 148/542 |
| 2015/0090372 | A1 * | 4/2015 | Branagan | C22C 38/002 148/542 |
| 2015/0101714 | A1 * | 4/2015 | Branagan | C22C 38/002 148/542 |
| 2015/0114587 | A1 * | 4/2015 | Branagan | C22C 38/58 164/464 |

OTHER PUBLICATIONS

International Search Report dated May 14, 2014 issued in related International Patent Application No. PCT/US2014/018053.

Chinese Office Action dated Aug. 3, 2016 issued in related Chinese Patent Application No. 201480018649.4.

* cited by examiner

CLASS OF WARM FORMING ADVANCED HIGH STRENGTH STEEL

CROSS REFERENCE TO RELATED APPLICATIONS

This application claims the benefit of U.S. Provisional Application Ser. No. 61/768,131 filed Feb. 22, 2013.

FIELD OF THE INVENTION

This present disclosure is directed at a new type of warm formable advanced high strength steel (AHSS). This steel can be warm formed due to its unique structure which allows it to develop relatively high strength without the need for austenitizing and quenching.

BACKGROUND

Existing hot forming steels are variations of martensitic grades produced by various trade names including USIBOR™, DUXTIBOR™, etc. This class of materials can develop high strength commonly in the 1200 to 1600 MPa range with limited ductility of 5 to 8%. In the as-produced condition, these grades of steel are in their annealed soft conditions and consist of mainly ferrite plus cementite and thus exhibit low tensile strength. To produce high strength parts, the steel must then be heated up to its austenitizing temperature (i.e. A3), which depending on the chemistry is typically in the range of 850 to 1000° C. After an appropriate hold time to form a single phase solid solution of austenite, the steel is then deformed to produce a part which can be a wide variety of structural and non-structural components. After deformation, the part is held to ensure the shape is maintained and then quenched in oil or water depending on the thickness of the part formed and the specific hardenability of the steel alloy. Often small additions of boron typically up to 0.05 wt % are used to increase the hardenability of the steel which means that it opens up the process window for martensite formation. Upon proper quenching, the steel part then forms a martensitic structure which is strong and brittle. Subsequent heat treating is commonly done to produce tempered martensite which results in an improvement of ductility through sacrificing some of the strength levels.

SUMMARY

The present disclosure is directed at steel alloys which may be wormed formed (treated at temperatures of 200° C. to 850° C. for time period of 1.0 second to 1 hour either by direct heating or induction heating). The elemental composition ranges (atomic percent) include: Fe present at 48.0 to 81.0, B at 2.0-8.0, Si at 4.0 to 14.0 and at least one austenite stabilizer (element that stabilizes austenite formation) comprising one or more of Cu, Mn and Ni, where the Cu is present at 0.1-6.0 atomic percent, Mn is present at 0.1-21.0 atomic percent and Ni is present at 0.1-16.0 atomic percent. Optionally, one may include Cr at a level of up to 32.0 atomic percent. Other optional elements such as C, Al, Ti, V, Nb, Mo, Zr, W and Pd may be present at up to 10.0 atomic percent. Impurities known/expected to be present include Nb, Ti, S, O, N, P, W, Co, Sn, which may present at levels up to 10.0 atomic percent. The alloys herein that are suitable for warm forming include the Class 1, Class 2 and Class 3 Steels described herein. Steel alloys of the present disclosure with application to centrifugal casting provide unique property combinations in wide ranges of strength and ductility depending on the aforementioned class of steel due to new enabling structure types facilitated by new enabling mechanisms.

DETAILED DESCRIPTION

New Class of Warm Forming Steel

Figure 1:
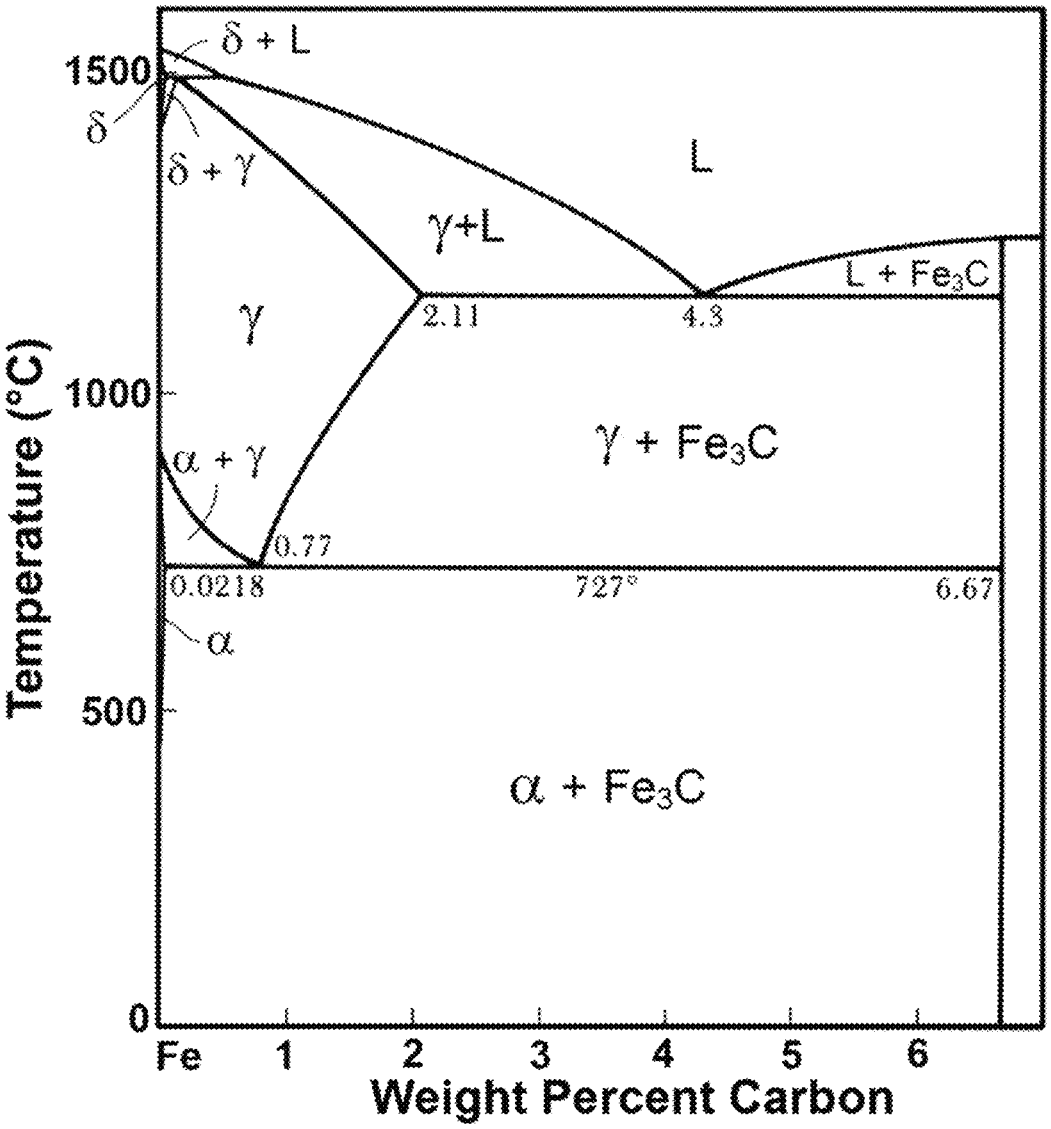
FIG. 1 Binary phase diagram for the iron rich region of the iron carbon binary system.
Figure 2:
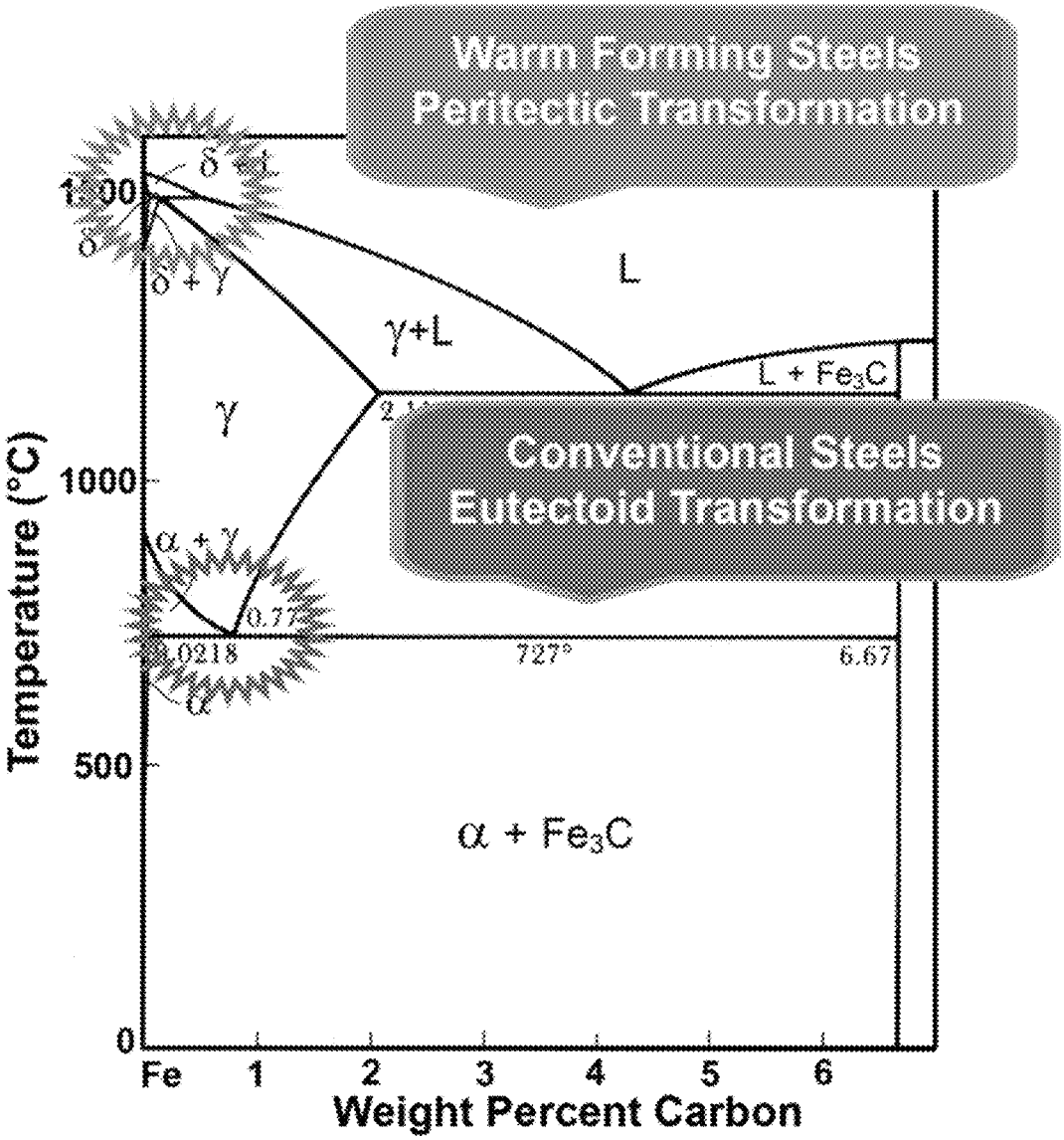
FIG. 2 Binary Fe—C phase diagram illustrating the differences between new grades of warm forming steel (top call-out) and conventional steels (bottom call-out).

The new class of warm forming steel does not need to be austenitized due to a much different metallurgy and enabling metallurgical transformations (i.e. not austenite to martensite). In FIG. 1, the iron rich binary portion of the binary Fe—C phase diagram is shown. This diagram is used to describe the basic phase equilibria in ~30,000 known worldwide equivalent iron and steel alloys. In FIG. 2, the Fe—C binary phase diagram is utilized to show the differences between the new class of warm forming steels and conventional steels. Almost all conventional steels with the exception of austenitic stainless and TWIP (Twinning Induced Plasticity) steels are developed with main focus of heat treatment and structural development based on the eutectoid transformation. While the heat treatment temperatures, times, and strategies can vary widely, generally the first step is to heat the steel up to the single phase austenite region. Heating rate to the targeted temperature and time at temperature is important as the hardenability of the steel is sensitive to the average grain size of the material. Depending on how the steel is cooled or quenched from the austenitizing temperature will result in a wide range of characteristic structures produced including pearlite, upper and lower bainite, spherodite, and martensite. Additionally, complex or dual phase microstructures can be produced with different fractions of all of these characteristic microstructures along with ferrite, retained austenite, and cementite phases.

As shown in FIG. 2, the new class of warm forming steels is intrinsically different as the focus on phase and structural development is on the peritectic region and not the eutectoid region. Note that the peritectic invariant reaction involves liquid with the specific transformation liquid+delta ferrite producing austenite. This is much different than the solid state eutectoid transformation which involves austenite producing ferrite plus cementite.

Figure 3:
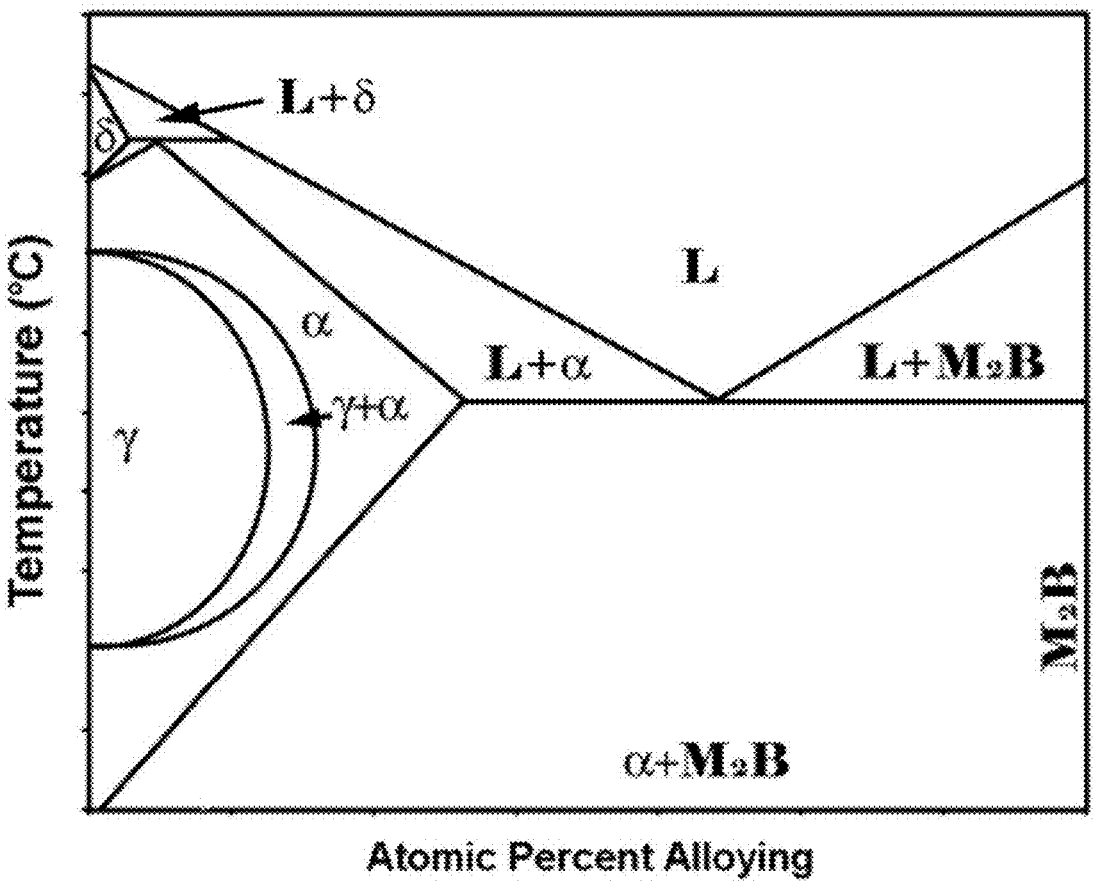
FIG. 3 Model phase diagram indicating the expected phase equilibria of the new warm forming steel grades.

To further explain these differences, a model phase diagram for the warm forming alloys is provided in FIG. 3. The x-axis (labeled as Atomic Percent Alloying) is reference to an alloy that, as noted above, comprises Fe, B and Si, and at least one of Cu, Mn or Ni. The temperature on the y-axis will then vary depending upon the alloy selected. As can be seen, the eutectoid transformation that is so crucial to existing steels is missing in the complex multicomponent phase diagram for the steels herein. Transitions include the initial solidification through the peritectic transformation and the high temperature portion of the austenite to ferrite transformation associated with the gamma/austenite stability loop.

The new type of steel produced herein may include any of the Class 1, Class 2 or Class 3 Steel Alloys noted herein that are warm formed, but preferably include warm forming of the Class 2 or Class 3 Steel Alloys. These Class 1, Class 2 and Class 3 Steel structure is stable to high temperatures and could be hot formed at conventional temperatures known for hot forming processes with typical hot forming ductility from 30 to 120%. However, the Class 1, Class 2 and Class 3 Steels herein exhibit relatively high strength and ductility at room temperature and maintains its high ductility at warm temperatures (i.e. 200 to 850°). Thus, it is applicable for cold deformation through a variety of methods including cold rolling, stamping, roll forming, hydroforming etc. Furthermore, the Class 1, Class 2 and Class 3 steel can now be treated by a warm forming process. In warm forming, the aforementioned steels are now heated up to a temperature range which is less than hot forming, typically 200 to 850° C., and for a time period of 1.0 seconds to 1 hour via direct heating (e.g. furnace heating) and/or induction heating. This temperature range is enabling for manufacturing for a number of key factors which will be described subsequently. In short, warm forming may now reduce cost while producing new functionality through minimizing or avoiding springback issues found in cold forming steels.

Enabling Advantages/New Functionality of Warm Forming Steels

Zinc Coatings

Steels are protected from corrosion through a process generally called galvanization which provides an anodic sacrificial coating to protect the surface of the steel from corrosion. There are various methods of applying the zinc or zinc alloy to the surface including conventional galvanization, hot dip galvanization, galvannealing etc. All of these processes share the same feature with zinc being bonded to different extents to the surface of steel. For hot forming this is a problem, since zinc exhibits a low melting point of 419° C. Thus, during hot forming of conventional martensitic/press formable steels, the zinc coating melts and vaporizes off, thus leaving the resulting steel part vulnerable to corrosive attack. While efforts are being done to produce thicker initial layers of zinc and/or to shorten the cycle time of hot forming to limit high temperature exposure, the results have been ineffective, resulting in costly post part forming coating steps to restore the anodic surface. Through warm forming at temperatures below the melting point of zinc (i.e. ~200 to ~419° C.), the problem of zinc loss can be minimized or entirely avoided. Thus the new NanoModal steels processed through warm forming creates new functionality through the ability to pre-coat with conventional galvanization processes and then maintaining this protective coating in the finished warm deformed part.

Cycle Time

Conventional hot forming lines utilize conveyor type continuous ovens which allow the hot formed parts to be feed in a continuous manner reaching their targeted austenitizing temperature prior to hot deformation. The length of these continuous gas fired ovens can be upwards of 50 meters and if any issue occurs during the hot forming operation, all of the parts moving through the long furnace are generally scrapped since during subsequent re-heating their metallurgical structure will be deleteriously non-recoverably affected. By heating up to lower temperature for warm forming, the length of this continuous oven used will be needed to be much less thus, requiring less infrastructure, lower amounts of scrapped parts, and especially lower energy cost. This ultimately results in lower cost parts thus, enabling the technology for a wider range of applications.

Oxidation/Post Processing

A cost factor limiting hot forming is the scale/oxide removal which forms during the elevated temperature exposure and then needs to be removed through existing shot/grit blasting processes. The oxidation occurs due to the elevated temperature exposure necessary to austenitize existing materials. Furthermore, the process does not lend itself to inert gas atmospheres because after hot forming, the parts must be quenched in a liquid medium to form martensite, thus creating additional oxidation. With the new class of Warm Forming steels, the temperature of deformation will be much lower which limits/prevents the oxidation typical for high temperature exposure. Additionally, since the Warm Forming steels do not need to be quenched and they exhibit an insensitive response to cooling rates in the solid state, the warm formed parts may be able to be processed while remaining in an inert atmosphere to prevent or minimize oxidation. This then is expected to result in a part which does not need to go through the expensive grit/shot blasting processes since scale formation is avoided.

Cooling/Water Quenching

Existing hot forming steels need to be quenched from their high temperature austenitizing temperatures in order to form the martensitic structure that provides high strength. During quenching into oil, water, salt water brines, etc. part distortion and/or cracking can occur which can create higher rates of scraps. Additionally, since the formation of the martensitic structure is highly cooling rate dependent, some areas of insufficient cooling may occur for example when a vapor barrier is created from the liquid medium. This results in lower strength levels in certain areas creating a limiting strength debit which while accounted for in the part design often results in higher gauge thicknesses and higher weight parts than necessary in order to overcome local strength variations. The new class of NanoModal Warm Forming Steels does not need to be water quenched and do not need to be heated up to the high temperatures found in conventional austenitizing. Thus, strict dimensional control is possible due to the lack of quench distortion. This results in a lower scrap rate and reduced cost enabling the technology.

Pre-Shaping/Final Finishing

Due to the fact that existing martensitic steels need to be austenitized at high temperatures, hot deformed, and then quenched in a liquid medium, the resulting part is distorted from the original blank dimensions. Due to the presence of distortion, especially during quenching, the final details (i.e. final trimming, hole incorporation, etc.) in the part cannot be pre-shaped in the starting blanks. Thus, expensive laser trimming or mechanical re-striking in a post stamping operation is needed which requires expensive dies that need regular maintenance to handle the extremely strong material resulting from the hot forming needed as a final post finishing process to put in the final holes and trim to the final part dimensions. Through warm forming, there is a lot less temperature range resulting in a lot less thermal expansion and this along with the lack of the need to quench, means that the Warm Forming Steels offer previously unknown design and process capability. Thus, the starting blanks can be fully or partially preformed with holes and trimmed appropriately prior to warm forming, thus creating new functionality and eliminating the final costly laser trimming processing inherent to existing hot forming processes.

New Classes of Steel Alloys

The non-stainless steel alloys herein are such that they are capable of formation of what is described herein as Class 1 Steel, Class 2 Steel or Class 3 Steel which are preferably crystalline (non-glassy) with identifiable crystalline grain size morphology. The ability of the alloys to form Class 1, Class 2 or Class 3 Steels herein is described in detail herein. However, it is useful to first consider a description of the general features of Class 1, Class 2 and Class 3 Steels, which is now provided below.

Class 1 Steel

Figure 4:
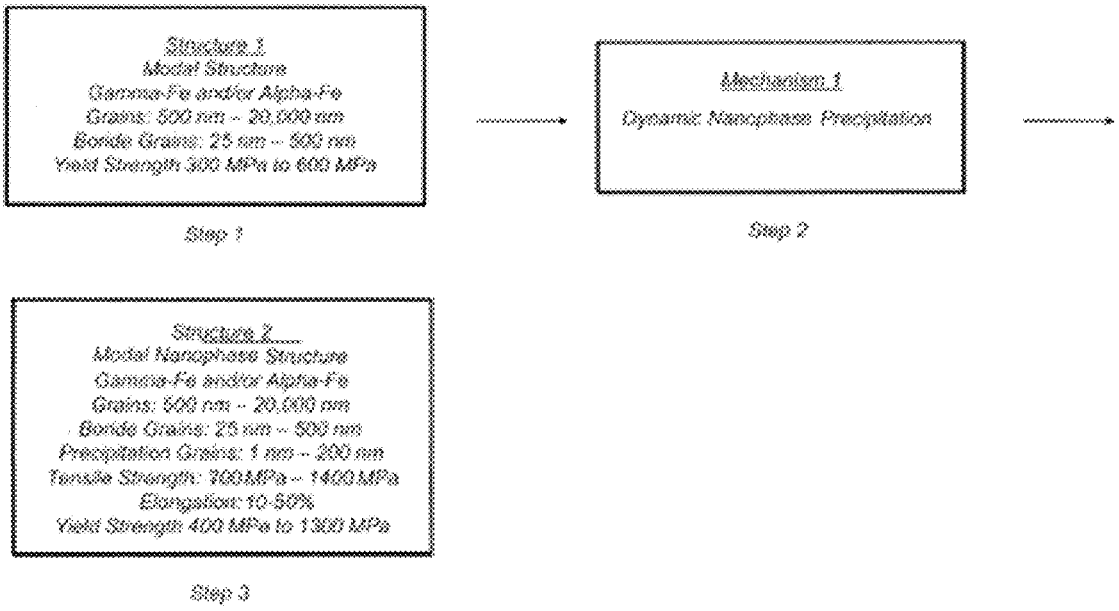
FIG. 4 illustrates structures and mechanisms regarding the formation of Class 1 Steel herein.

The formation of Class 1 Steel herein is illustrated in FIG. 4. As shown therein, a Modal structure is initially formed which modal structure is the result of starting with a liquid melt of the alloy and solidifying by cooling, which provides nucleation and growth of particular phases having particular grain sizes. Reference herein to modal may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure #1 of the Class 1 Steel may be preferably achieved by processing through either laboratory scale procedures and/or through industrial scale methods such as powder atomization or alloy casting.

The Modal Structure of Class 1 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$.

The Modal Structure of Class 1 Steel may be subjected to thermomechanical deformation and/or heat treatment, resulting in some variation in properties, but the Modal Structure may be maintained.

Figure 5:
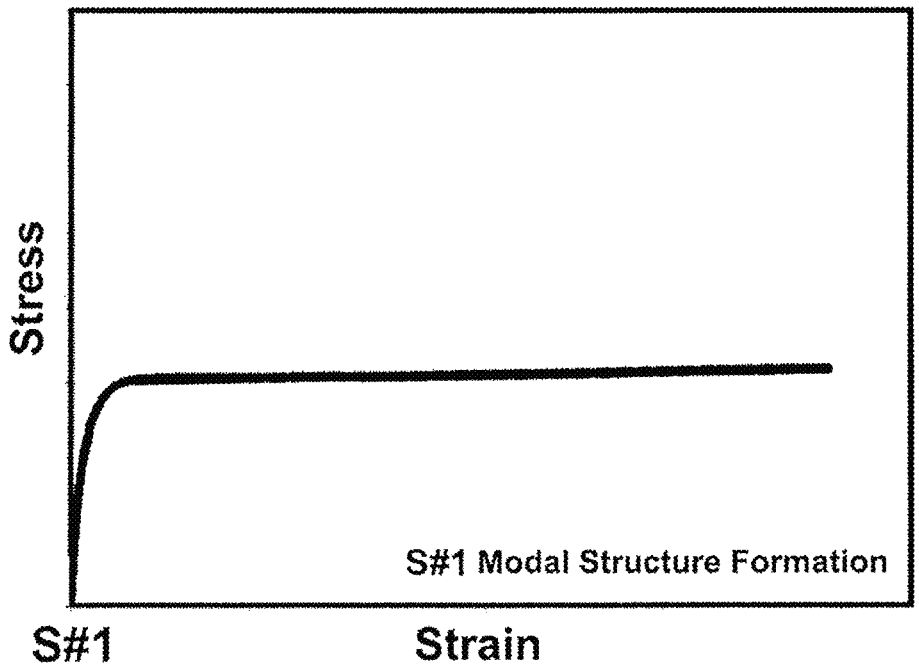
FIG. 5 illustrates a representative stress-strain curve of a material with Modal Structure.

When the Class 1 Steel noted above is exposed to a mechanical stress, the observed stress versus strain diagram is illustrated in FIG. 5. It is therefore observed that the Modal Structure undergoes what is identified as Dynamic Nanophase Precipitation leading to a second type structure for the Class 1 Steel which is Modal Nanophase Structure. Such Dynamic Nanophase Precipitation is therefore triggered when the alloy experiences a yield under stress, and it has been found that the yield strength of Class 1 Steels which undergo Dynamic Nanophase Precipitation may preferably occur at 400 MPa to 1300 MPa. Accordingly, it may be appreciated that Dynamic Nanophase Precipitation occurs due to the application of mechanical stress that exceeds such indicated yield strength. Dynamic Nanophase Precipitation itself may be understood as the formation of a further identifiable phase in the Class 1 Steel which is termed a precipitation phase with an associated grain size. That is, the result of such Dynamic Nanophase Precipitation is to form an alloy which still indicates identifiable matrix grain size of 500 nm to 20,000 nm, boride pinning grain size of 25 nm to 500 nm, along with the formation of precipitation grains which contain hexagonal phases and grains of 1.0 nm to 200 nm. As noted above, the grain sizes therefore do not coarsen when the alloy is stressed, but does lead to the development of the precipitation grains as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 700 MPa to 1400 MPa, with an elongation of 10-50%. Furthermore, the second type structure of the Class 1 Steel is such that it exhibits a strain hardening coefficient from 0.1 to 0.4 that is nearly flat after undergoing the indicated yield. The strain hardening coefficient is reference to the n-value in the formula $\sigma=K\epsilon^n$, where $\sigma$ represents the applied stress on the material, $\epsilon$ is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force).

Table 1A below provides a comparison and performance summary for Class 1 Steel herein.

TABLE 1A

Comparison of Structure and Performance for Class 1 Steel

| Property/ Mechanism | Class 1 Steel: Structure Type #1 Modal Structure | Class 1 Steel: Structure Type #2 Modal Nanophase Structure |
|---|---|---|
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning | Austenite, optionally ferrite, boride pinning phases, and hexagonal phase(s) precipitation |
| Matrix Grain Size | 500 to 20,000 nm Austenite and/or ferrite | 500 to 20,000 nm Austenite optionally ferrite |
| Boride Grain Size | 25 to 500 nm Non metallic (e.g. metal boride) | 25 to 500 nm Non-metallic (e.g. metal boride) |
| Precipitation Grain Sizes | — | 1 nm to 200 nm Hexagonal phase(s) |
| Tensile Response | Intermediate structure; transforms into Structure #2 when undergoing yield | Actual with properties achieved based on structure type #2 |
| Yield Strength | 300 to 600 MPa | 400 to 1300 MPa |
| Tensile Strength | — | 700 to 1400 MPa |
| Total Elongation | — | 10 to 50% |
| Strain Hardening Response | — | Exhibits a strain hardening coefficient between 0.1 to 0.4 and a strain hardening coefficient as a function of strain which is nearly flat or experiencing a slow increase until failure |

Class 2 Steel

Figure 6:
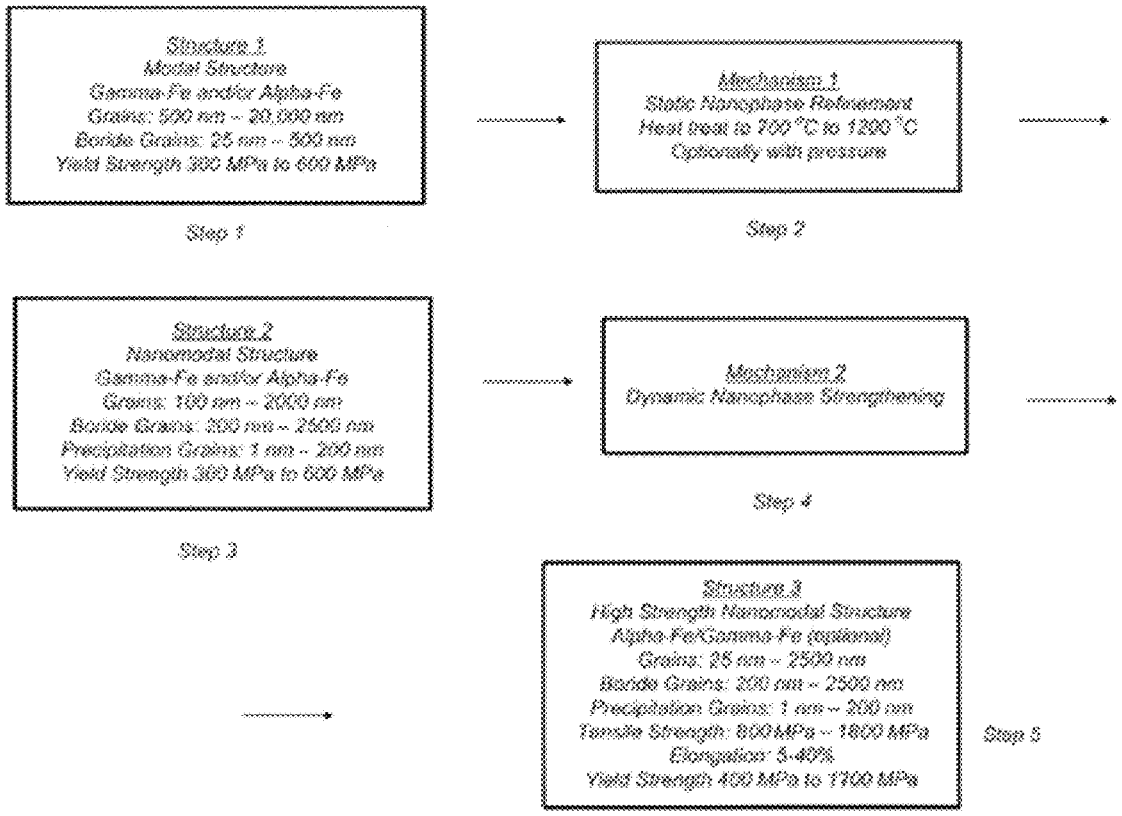
FIG. 6 illustrates structures and mechanism regarding the formation of Class 2 steel alloys herein.

The formation of Class 2 Steel herein is illustrated in FIG. 6. Class 2 steel may also be formed herein from the identified alloys, which involves two new structure types after starting with Structure type #1, Modal Structure, followed by two new mechanisms identified herein as Static Nanophase Refinement and Dynamic Nanophase Strengthening. The new structure types for Class 2 Steel are described herein as Nanomodal Structure and High Strength Nanomodal Structure. Accordingly, Class 2 Steel herein may be characterized as follows: Structure #1-Modal Structure (Step #1), Mechanism #1—Static Nanophase Refinement (Step #2), Structure #2-Nanomodal Structure (Step #3), Mechanism #2—Dynamic Nanophase Strengthening (Step #4), and Structure #3—High Strength Nanomodal Structure (Step #5).

As shown therein, Structure #1 is initially formed in which Modal Structure is the result of starting with a liquid melt of the alloy and solidifying by cooling, which provides nucleation and growth of particular phases having particular grain sizes. Grain size herein may again be understood as the size of a single crystal of a specific particular phase preferably identifiable by methods such as scanning electron microscopy or transmission electron microscopy. Accordingly, Structure #1 of the Class 2 Steel may be preferably achieved by processing through either laboratory scale procedures and/or through industrial scale methods such as powder atomization or alloy casting.

The Modal Structure of Class 2 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which are referenced to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanisms #1 or #2 noted above). Reference to grain size is again to be understood as the size of a single crystal of a specific particular phase preferably identifiable by methods such as scanning electron microscopy or transmission electron microscopy. Furthermore, Structure #1 of Class 2 steel herein includes austenite and/or ferrite along with such boride phases.

Figure 7:
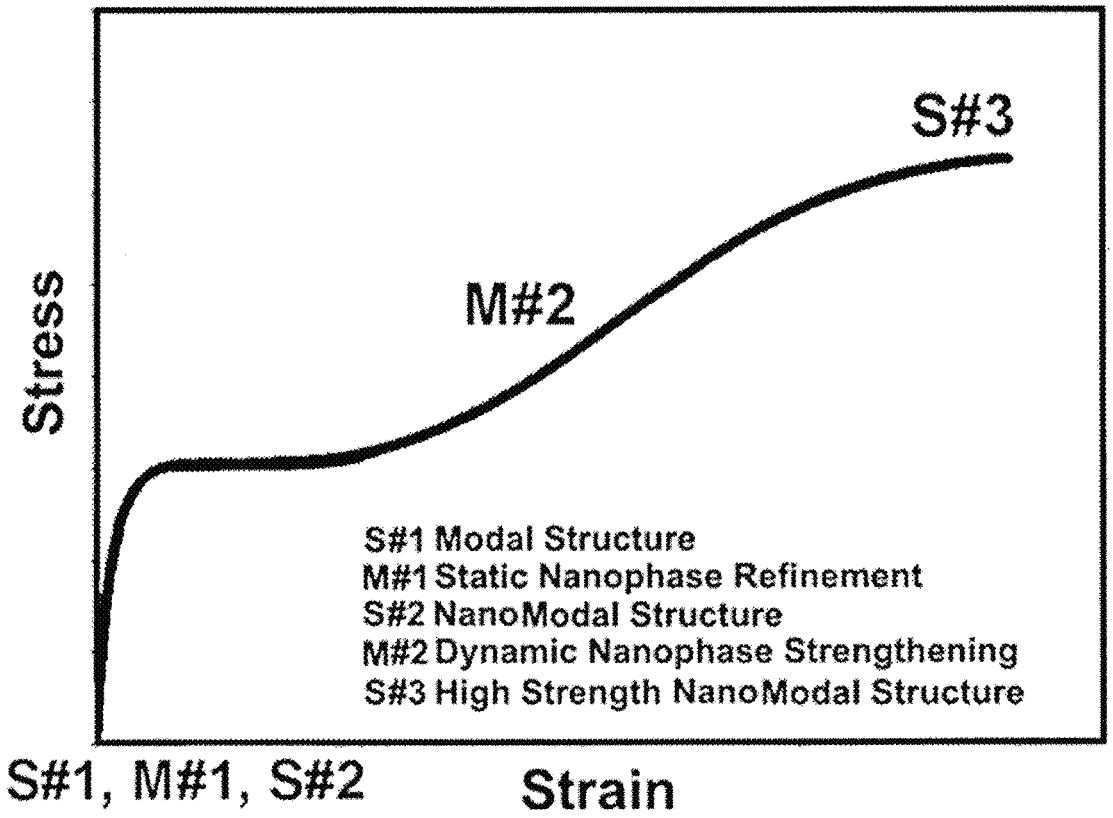
FIG. 7 illustrates a stress-strain curve for the indicated structures and associated mechanisms in Class 2 alloys.

In FIG. 7, a stress strain curve is shown that represents the non-stainless steel alloys herein which undergo a deformation behavior of Class 2 steel. The Modal Structure is preferably first created (Structure #1) and then after the creation, the Modal Structure may now be uniquely refined through Mechanism #1, which is a Static Nanophase Refinement mechanism, leading to Structure #2. Static Nanophase Refinement is reference to the feature that the matrix grain sizes of Structure 1 which initially fall in the range of 500 nm to 20,000 nm are reduced in size to provide Structure 2 which has matrix grain sizes that typically fall in the range of 100 nm to 2000 nm. Note that the boride pinning phase can change size significantly in some alloys, while it is designed to resist matrix grain coarsening during the heat treatments. Due to the presence of these boride pinning sites, the motion of a grain boundaries leading to coarsening would be expected to be retarded by a process called Zener pinning or Zener drag. Thus, while grain growth of the matrix may be energetically favorable due to the reduction of total interfacial area, the presence of the boride pinning phase will counteract this driving force of coarsening due to the high interfacial energies of these phases.

Characteristic of the Static Nanophase Refinement Mechanism #1 in Class 2 steel, the micron scale austenite phase (gamma-Fe) which was noted as falling in the range of 500 nm to 20,000 nm is partially or completely transformed into new phases (e.g. ferrite or alpha-Fe). The volume fraction of ferrite (alpha-iron) initially present in the Modal Structure (Structure 1) of Class 2 steel is 0 to 45%. The volume fraction of ferrite (alpha-iron) in Structure #2 as a result of Static Nanophase Refinement Mechanism #2 is typically from 20 to 80%. The static transformation preferably occurs during elevated temperature heat treatment and thus involves a unique refinement mechanism since grain coarsening rather than grain refinement is the conventional material response at elevated temperature.

Accordingly, grain coarsening does not occur with the alloys of Class 2 Steel herein during the Static Nanophase Refinement mechanism. Structure #2 is uniquely able to transform to Structure #3 during Dynamic Nanophase Strengthening and as a result Structure #3 is formed and indicates tensile strength values in the range from 800 to 1800 MPa with 5 to 40% total elongation.

Depending on alloy chemistries, nano-scale precipitates can form during Static Nanophase Refinement and the subsequent thermal process in some of the non-stainless high-strength steels. The nano-precipitates are in the range of 1 nm to 200 nm, with the majority (>50%) of these phases 10~20 nm in size, which are much smaller than the boride pinning phase formed in Structure #1 for retarding matrix grain coarsening. Also, during Static Nanophase Refinement, the boride grain sizes grow larger to a range from 200 to 2500 nm in size.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases (FIG. 7) and the strength increases with strain indicating an activation of Mechanism #2 (Dynamic Nanophase Strengthening).

With further straining during Dynamic Nanophase Strengthening, the strength continues to increase but with a gradual decrease in strain hardening coefficient value up to nearly failure. Some strain softening occurs but only near the breaking point which may be due to reductions in localized cross sectional area at necking. Note that the strengthening transformation that occurs at the material straining under the stress generally defines Mechanism #2 as a dynamic process, leading to Structure #3. By dynamic, it is meant that the process may occur through the application of a stress which exceeds the yield point of the material. The tensile properties that can be achieved for alloys that achieve Structure 3 include tensile strength values in the range from 800 to 1800 MPa and 5 to 40% total elongation. The level of tensile properties achieved is also dependent on the amount of transformation occurring as the strain increases corresponding to the characteristic stress strain curve for a Class 2 steel.

Thus, depending on the level of transformation, tunable yield strength may also now be developed in Class 2 Steel herein depending on the level of deformation and in Structure #3 the yield strength can ultimately vary from 400 MPa to 1700 MPa. That is, conventional steels outside the scope of the alloys here exhibit only relatively low levels of strain hardening, thus their yield strengths can be varied only over small ranges (e.g., 100 to 200 MPa) depending on the prior deformation history. In Class 2 steels herein, the yield strength can be varied over a wide range (e.g. 400 to 1700 MPa) as applied to Structure #2 transformation into Structure #3, allowing tunable variations to enable both the designer and end users in a variety of applications, and utilize Structure #3 in various applications such as crash management in automobile body structures.

With regards to this dynamic mechanism, new and/or additional precipitation phase or phases are observed that indicates identifiable grain sizes of 1 nm to 200 nm. In addition, there is the further identification in said precipitation phase a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. That is, Structure #3 may be understood as a microstructure having matrix grains sized generally from 100 nm to 2000 nm which are pinned by boride phases which are in the range of 200 to 2500 nm and with precipitate phases which are in the range of 1 nm to 200 nm. The initial formation of the above referenced precipitation phase with grain sizes of 1 nm to 200 nm starts at Static Nanophase Refinement and continues during Dynamic Nanophase Strengthening leading to Structure 3 formation. The volume fraction of the precipitation phase with grain size from 1 nm to 200 nm in Structure 2 increases in Structure 3 and assists with the identified strengthening mechanism. It should also be noted that in Structure 3, the level of gamma-iron is optional and may be eliminated depending on the specific alloy chemistry and austenite stability.

Note that dynamic recrystallization is a known process but differs from Mechanism #2 (FIG. 6) since it involves the formation of large grains from small grains so that it is not a refinement mechanism but a coarsening mechanism. Additionally, as new undeformed grains are replaced by deformed grains no phase changes occur in contrast to the mechanisms presented here and this also results in a corresponding reduction in strength in contrast to the strengthening mechanism here. Note also that metastable austenite in steels is known to transform to martensite under mechanical stress but, preferably, no evidence for martensite or body centered tetragonal iron phases are found in the new steel alloys described in this application.

Table 1B below provides a comparison of the structure and performance features of Class 2 Steel herein.

TABLE 1B

Comparison Of Structure and Performance of Class 2 Steel

| Property/ Mechanism | Class 2 Steel | | |
|---|---|---|---|
| | Structure Type #1 Modal Structure | Structure Type #2 Nanomodal Structure | Structure Type #3 High Strength Nanomodal Structure |
| Structure Formation | Starting with a liquid melt, solidifying this liquid melt and forming directly | Static Nanophase Refinement mechanism occurring during heat treatment | Dynamic Nanophase Strengthening mechanism occurring through application of mechanical stress |
| Transformations | Liquid solidification followed by nucleation and growth | Solid state phase transformation of supersaturated gamma iron | Stress induced transformation involving phase formation and precipitation |
| Enabling Phases | Austenite and/or ferrite with boride pinning phases | Ferrite, austenite, boride pinning phases, and hexagonal phase precipitation | Ferrite, optionally austenite, boride pinning phases, hexagonal and additional phases precipitation |
| Matrix Grain Size | 500 to 20000 nm Austenite | Grain Refinement (100 nm to 2000 nm) Austenite to ferrite and precipitation phase transformation | Grain size remains refined at 100 nm to 2000 nm/Additional precipitation formation |
| Boride Grain Size | 25 to 500 nm borides (e.g. metal boride) | 200 to 2500 nm borides (e.g. metal boride) | 200 to 2500 nm borides (e.g. metal boride) |
| Precipitation Grain Sizes | — | 1 nm to 200 nm | 1 nm to 200 nm |
| Tensile Response | Actual with properties achieved based on structure type #1 | Intermediate structure; transforms into Structure #3 when undergoing yield | Actual with properties achieved based on formation of structure type #3 and fraction of transformation. |
| Yield Strength | 300 to 600 MPa | 300 to 800 MPa | 400 to 1700 MPa |
| Tensile Strength | — | — | 800 to 1800 MPa |
| Total Elongation | — | — | 5 to 40% |
| Strain Hardening Response | — | After yield point, exhibit a strain softening at initial straining as a result of phase transformation, followed by a significant strain hardening effect leading to a distinct maxima | Strain hardening coefficient may vary from 0.2 to 1.0 depending on amount of deformation and transformation |

Class 3 Steel

Class 3 steel is associated with formation of a High Strength Lamellae Nanomodal Structure through a multi-step process as now described herein.

Figure 8:
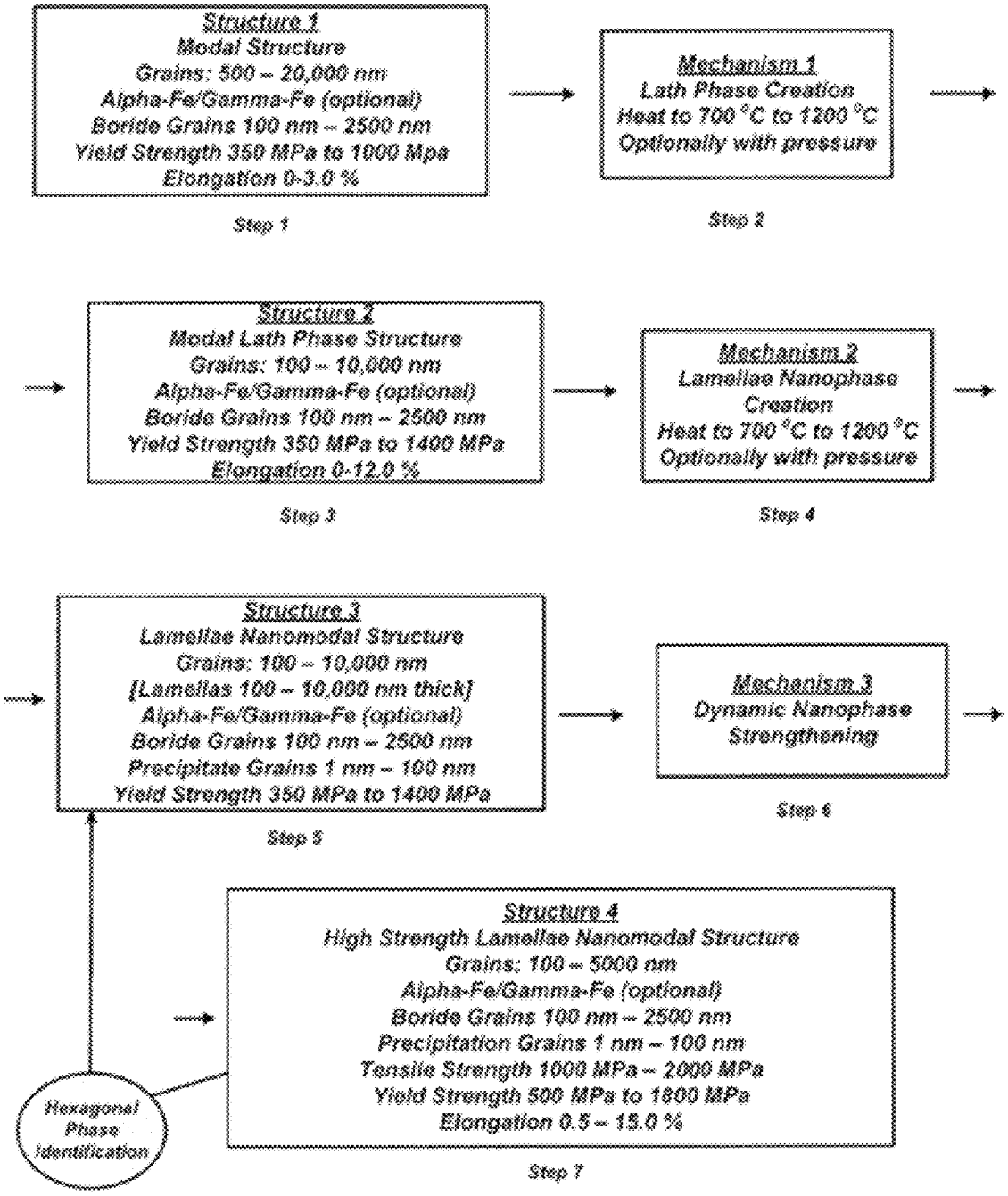
FIG. 8 illustrates structures and mechanism regarding the formation of Class 3 steel alloys herein.

In order to achieve a tensile response involving high strength with adequate ductility in non-stainless carbon-free steel alloys, a preferred seven-step process is now disclosed and shown in FIG. 8. Structure development starts from the Structure #1—Modal Structure (Step #1). However, Mechanism #1 in Class 3 steel is now related to Lath Phase Creation (Step #2) that leads to Structure #2—Modal Lath Phase Structure (Step #3), which through Mechanism #2—Lamellae Nanophase Creation (Step #4) transforms into Structure #3—Lamellae Nanomodal Structure (Step #5). Deformation of Structure #3 results in activation of Mechanism #3-Dynamic Nanophase Strengthening (Step #6) which leads to formation of Structure #4—High Strength Lamellae Nanomodal Structure (Step #7). Reference is also made to Table 1C below.

Structure #1 involving the formation of the Modal Structures (i.e. bi, tri, and higher order) may be achieved in the alloys with the referenced chemistries in this application by processing through the laboratory scale as shown and/or through industrial scale methods involving chill surface processing such as twin roll casting or thin slab casting. The Modal Structure of Class 3 Steel will therefore initially indicate, when cooled from the melt, the following grain sizes: (1) matrix grain size of 500 nm to 20,000 nm containing ferrite or alpha-Fe (required) and optionally austenite or gamma-Fe; and (2) boride grain size of 100 nm to 2500 nm (i.e. non-metallic grains such as $M_2B$ where M is the metal and is covalently bonded to B); (3) yield strengths of 350 to 1000 MPa; (4) tensile strengths of 400 to 1200 MPa; and total elongation of 0-3.0%. It will also indicate dendritic growth morphology of the matrix grains. The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanism #1, #2 or #3 noted above). Reference to grain size is again to be understood as the size of a single crystal of a specific particular phase preferably identifiable by methods such as scanning electron microscopy or transmission electron microscopy. Accordingly, Structure #1 of Class 3 steel herein includes ferrite along with such boride phases.

Structure #2 involves the formation of the Modal Lath Phase Structure with uniformly distributed precipitates from Modal Structure (Structure 1) with dendritic morphology though Mechanism #1. Lath phase structure may be generally understood as a structure composed from plate-shaped crystal grains. Reference to "dendritic morphology" may be understood as tree-like and reference to "plate shaped" may be understood as sheet like. Lath structure formation preferably occurs at elevated temperature (e.g. at temperatures of 700° C. to 1200° C.) through plate-like crystal grain formation with: (1) lath structural grain sizes typically from 100 to 10,000 nm; (2) boride grain size of 100 nm to 2,500 nm; (3) yield strengths of 350 MPa to 1400 MPa; (4) tensile strengths of 350 MPa to 1600 MPa; (5) elongation of 0-12%. Structure #2 also contains alpha-Fe and gamma-Fe remains optional.

A second phase of boride precipitates with a size typically from 100 to 1000 nm may be found distributed in the lath matrix as isolated particles. The second phase of boride precipitates may be understood as non-metallic grains of different stoichiometry ($M_2B$, $M_3B$, MB ($M_1B_1$), $M_{23}B_6$, and $M_7B_3$) where M is the metal and is covalently bonded to Boron. These boride precipitates are distinguished from the boride grains in Structure #1 with little or no change in size.

Structure #3 (Lamellae Nanomodal Structure) involves the formation of the lamellae morphology as a result of static transformation of ferrite into one or several phases through Mechanism #2 identified as Lamellae Nanophase Creation. Static transformation is a decomposition of the parent phase into new phase or several new phases due to alloying elements distribution by diffusion during elevated temperature heat treatment, which may preferably occur in the temperature range from 700° C. to 1200° C. Lamellae (or layered) structure is composed of alternating layers of two phases whereby individual lamellae exist within a colony connected in three dimensions. In Class 3 alloys, Lamellae Nanomodal Structure contains: (1) lamellas of 100 nm to 1000 nm wide with a thickness in the range of 100 nm to 10,000 nm and with a length of 0.1 to 5 microns; (2) boride grains of 100 nm to 2500 nm of different stoichiometry ($M_2B$, $M_3B$, MB ($M_1B_1$), $M_{23}B_6$, and $M_7B_3$) where M is the metal and is covalently bonded to Boron, (3) precipitation grains of 1 nm to 100 nm; (4) yield strength of 350 MPa to 1400 MPa. The Lamellae Nanomodal Structure continues to contain alpha-Fe and gamma-Fe remains optional.

Figure 9:
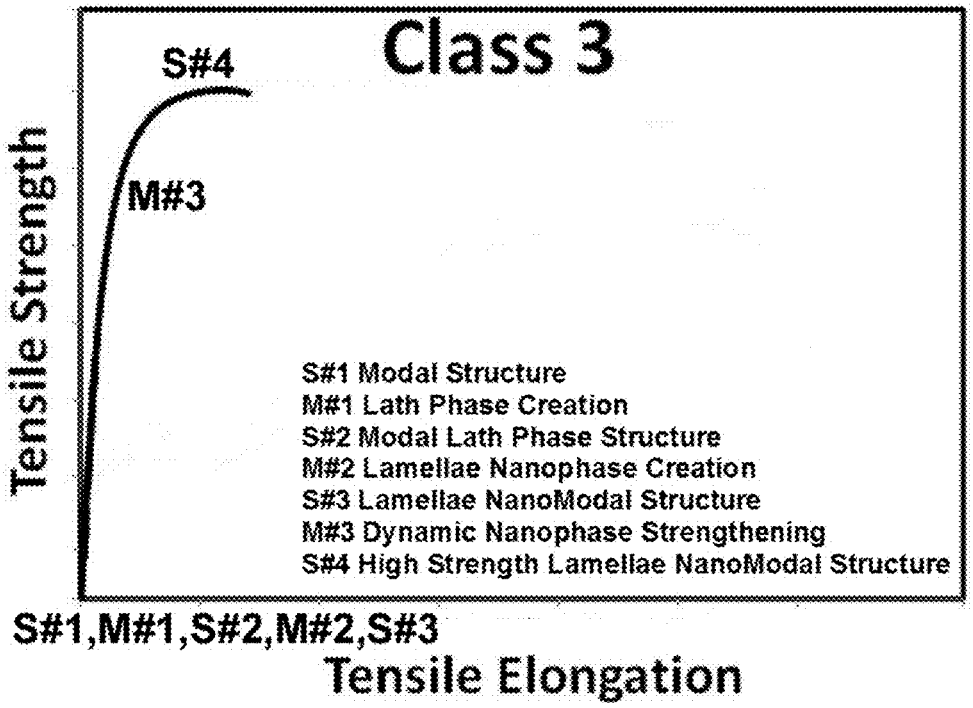
FIG. 9 illustrates a stress-strain curve for the indicated structures and associated mechanisms in Class 3 alloys.

Lamellae Nanomodal Structure (Structure #3) transforms into Structure #4 through Dynamic Nanophase Strengthening (Mechanism #3, exposure to mechanical stress) during plastic deformation (i.e. exceeding the yield stress for the material) displaying relatively high tensile strengths in the range of 1000 MPa to 2000 MPa. In FIG. 9, a stress-strain curve is shown that represents the alloys with Structure #3 herein which undergo a deformation behavior of Class 3 steel as compared to that of Class 2. As illustrated in FIG. 9, Structure #3, upon application of stress, provides the indicated curve, resulting in Structure #4 of Class 3 steel.

The strengthening during deformation is related to phase transformation that occurs as the material strains under stress and defines Mechanism #3 as a dynamic process. For the alloy to display high strength at the level described in this application, lamellae structure is preferably formed prior to deformation. Specific to this mechanism, the micron scale austenite phase is transformed into new phases with reductions in microstructural feature scales generally down to the nanoscale regime. Some fraction of austenite may initially form in some Class 3 alloys during casting and then may remain present in Structure #1 and Structure #2. During straining when stress is applied, new or additional phases are formed with nanograins typically in a range from 1 to 100 nm.

In the post-deformed Structure #4 (High Strength Lamellae Nanomodal Structure), the ferrite grains contain alternating layers with nanostructure composed from new phases formed during deformation. Depending on the specific chemistry and the stability of the austenite, some austenite may be additionally present. In contrast with layers in Structure #3 where each layer represents a single or just few grains, in Structure #4, a large number of nanograins of different phases are present as a result of Dynamic Nanophase Strengthening. Since nanoscale phase formation occurs during alloy deformation, it represents a stress induced transformation and defined as a dynamic process. Nanoscale phase precipitations during deformation are responsible for extensive strain hardening of the alloys. The dynamic transformation can occur partially or completely and results in the formation of a microstructure with novel nanoscale/near nanoscale phases specified as High Strength Lamellae Nanomodal Structure (Structure #4) that provides high strength in the material. Thus the Structure #4 can be formed with various levels of strengthening depending on specific chemistry and the amount of strengthening achieved by Mechanism #3.

Table 1C below provides a comparison of the structure and performance features of Class 3 Steel herein.

TABLE 1C

Comparison of Structure and Performance of New Structure Types

| | Class 3 Steel | | | |
|---|---|---|---|---|
| Property/ Mechanism | Structure Type #1 Modal Structure | Structure Type #2 Modal Lath Phase Structure | Structure Type #3 Lamellae Nanomodal Structure | Structure Type #4 High Strength Lamellae Nanomodal Structure |
| Structure Formation | Starting with a liquid melt, solidifying on a chill surface | As-cast structural homogenization and lath phase formation during high temperature heat treatment optionally with pressure | Lath phase dissolution and Lamellae Nanomodal Structure creation during heat treatment | Nanoprecipitate phase formation and high strength structure formation through application of stress |
| Transformations | Liquid solidification followed by nucleation and growth | Morphology change (dendrites to laths) | Solid state phase transformation of supersaturated alpha iron | Stress induced transformation involving phase formation and precipitation |

TABLE 1C-continued

| Comparison of Structure and Performance of New Structure Types | | | | |
|---|---|---|---|---|
| | Class 3 Steel | | | |
| Property/ Mechanism | Structure Type #1 Modal Structure | Structure Type #2 Modal Lath Phase Structure | Structure Type #3 Lamellae Nanomodal Structure | Structure Type #4 High Strength Lamellae Nanomodal Structure |
| Enabling Phases | Ferrite, optionally austenite with boride pinning phases | Ferrite, optionally austenite with boride pinning phases | Ferrite, optionally austenite, boride, and additional phase precipitations | Ferrite, optionally austenite, boride, and additional phase precipitations |
| Matrix Grain Size | 500 to 20,000 nm | 100 to 10,000 nm | 100 to 10,000 nm thick lamellae, 0.1- 5.0 microns in length and 100 nm-1000 nm in width | 100 to 5000 nm, non-uniform grains |
| Boride Grain Size | 100 to 2,500 nm | 100 to 2,500 nm | 100 to 2,500 nm | 100 to 2,500 nm |
| Precipitate Grains | N/A | N/A | 1 to 100 nm | 1 to 100 nm |
| Tensile Response | Actual with properties achieved based on structure type #1 | Actual with properties achieved based on structure type #2 | Intermediate structure; transforms into Structure #4 during tensile testing | Actual with properties achieved based on formation of structure type #3 and fraction of transformation |
| Yield Strength | 350 to 1000 MPa | 300 to 1400 MPa | 350 to 1400 MPa | 500 to 1800 MPa |
| Tensile Strength | 200 to 1200 MPa | 350 to 1600 MPa | — | 1000 to 2000 MPa |
| Total Elongation | 0 to 3% | 0 to 12% | — | 0.5 to 15% |
| Strain hardening Response | Exhibits limited hardening resulted in low ductility | Strain hardening coefficient may vary from 0.09 to 0.73 depending on alloy chemistry and level of structural formation | After yield point, exhibit a high strain hardening coefficient at initial straining and a strain hardening coefficient as a function of strain which is experiencing a decrease until failure | Strain Hardening coefficient may vary from 0.1 to 0.9 depending on amount of deformation and transformation |

Alloy Properties

In the new alloys, melting occurs in one or multiple stages with initial melting from ~1000° C. depending on alloy chemistry and final melting temperature might be up to ~1500° C. Variations in melting behavior reflect a complex phase formation at chill surface processing of the alloys depending on their chemistry. The density of the alloys varies from 7.2 g/cm$^3$ to 8.2 g/cm$^3$. The mechanical characteristic values in the alloys from each Class will depend on alloy chemistry and processing/treatment condition. For Class 1 Steels, the ultimate tensile strength values may vary from 700 to 1500 MPa with tensile elongation from 5 to 40%. The yield stress is in a range from 400 to 1300 MPa. For Class 2 Steels, the ultimate tensile strength values may vary from 800 to 1800 MPa with tensile elongation from 5 to 40%. The yield stress is in a range from 400 to 1700 MPa. For Class 3 Steels, the ultimate tensile strength values may vary from 1000 to 2000 MPa with tensile elongation from 0.5 to 15%. The yield stress is in a range from 500 to 1800 MPa. Additional classes of steel are anticipated with possible yield strengths, tensile strengths, and elongation values outside of the limits listed above.

EXAMPLES

Preferred Alloy Chemistries and Sample Preparation

Figure 10:
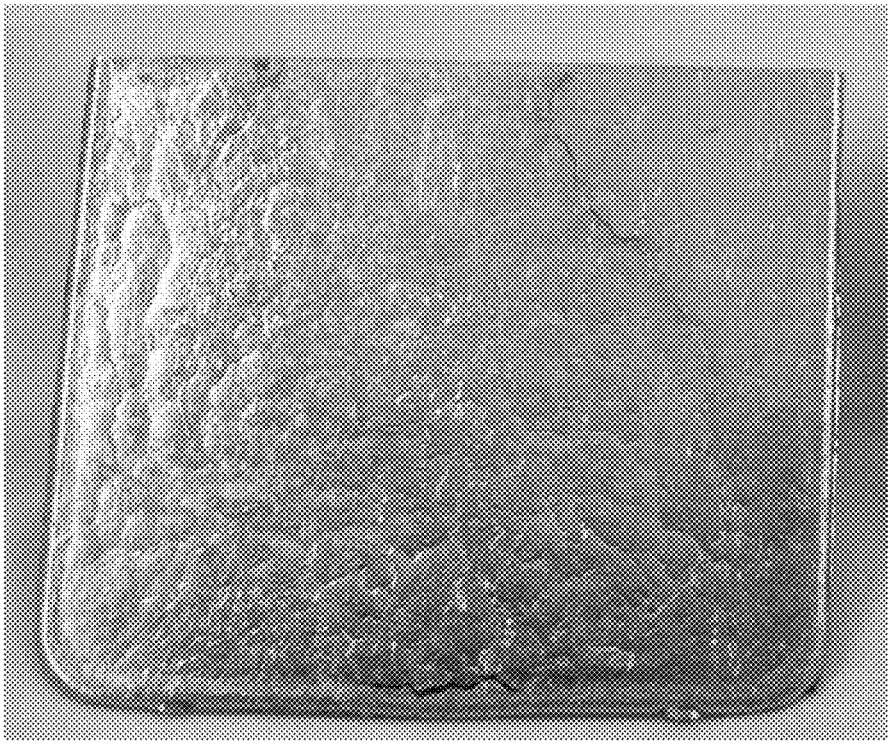
FIG. 10 Picture of the plate in as-cast state.

The chemical composition of the alloys studied is shown in Table 2 which provides the preferred atomic ratios utilized. These chemistries have been studied by using material processing through sheet casting in a Pressure Vacuum Caster (PVC). Using high purity elements or ferroadditives and other readily commercially available constituents, 35 g alloy feedstocks of the targeted alloys were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting 3 by 4 inches sheets with thickness of 1.8 mm. An example of the cast plate is shown in FIG. 10. Utilized die casting of the alloys relates to the melt solidification at relatively high cooling rate that can be correlated with metal solidification at different sheet production methods including but not limited to sheet solidification on chill surface at twin roll, thin strip, and thin slab casting.

TABLE 2

Chemical Composition of the Alloys (atomic %)

| Alloy | Fe | Cr | Ni | B | Si | W | Mo | Nb | Ti | Al | Cu | V | Zr | Mn | C |
|---|---|---|---|---|---|---|---|---|---|---|---|---|---|---|---|
| Alloy 1 | 59.35 | 17.43 | 14.05 | 4.77 | 4.40 | — | — | — | — | — | — | — | — | — | — |
| Alloy 2 | 58.35 | 17.43 | 14.05 | 4.77 | 4.40 | — | — | — | — | — | — | 1.00 | — | — | — |
| Alloy 3 | 54.52 | 17.43 | 14.05 | 7.00 | 7.00 | — | — | — | — | — | — | — | — | — | — |
| Alloy 4 | 53.52 | 17.43 | 14.05 | 7.00 | 5.00 | — | — | — | — | — | — | 3.00 | — | — | — |
| Alloy 5 | 55.52 | 17.43 | 14.05 | 7.00 | 5.00 | — | — | — | — | — | — | — | 1.00 | — | — |
| Alloy 6 | 60.22 | 17.43 | 11.05 | 5.00 | 6.30 | — | — | — | — | — | — | — | — | — | — |
| Alloy 7 | 77.05 | — | 11.05 | 5.30 | 6.60 | | | | | | | | | | |
| Alloy 8 | 58.92 | 17.43 | 11.05 | 5.60 | 7.00 | — | — | — | — | — | — | — | — | — | — |
| Alloy 9 | 58.27 | 17.43 | 11.05 | 5.90 | 7.35 | — | — | — | — | — | — | — | — | — | — |
| Alloy 10 | 59.25 | 17.43 | 11.05 | 5.45 | 6.82 | — | — | — | — | — | — | — | — | — | — |
| Alloy 11 | 59.25 | 17.43 | 8.29 | 5.45 | 6.82 | — | — | — | — | — | — | — | — | 2.76 | — |
| Alloy 12 | 61.25 | 15.43 | 5.53 | 5.45 | 6.82 | — | — | — | — | — | — | — | — | 5.52 | — |
| Alloy 13 | 63.62 | 17.43 | 7.05 | 5.30 | 6.60 | — | — | — | — | — | — | — | — | — | — |
| Alloy 14 | 63.22 | 17.43 | 7.05 | 5.00 | 6.30 | 1.00 | — | — | — | — | — | — | — | — | — |
| Alloy 15 | 66.35 | 17.43 | 7.05 | 4.77 | 4.40 | — | — | — | — | — | — | — | — | — | — |
| Alloy 16 | 62.22 | 19.43 | 7.05 | 5.00 | 6.30 | — | — | — | — | — | — | — | — | — | — |
| Alloy 17 | 59.90 | 22.03 | 6.17 | 5.30 | 6.60 | — | — | — | — | — | — | — | — | — | — |
| Alloy 18 | 61.67 | 19.21 | 7.22 | 5.30 | 6.60 | — | — | — | — | — | — | — | — | — | — |
| Alloy 19 | 66.95 | 10.75 | 10.40 | 5.30 | 6.60 | — | — | — | — | — | — | — | — | — | — |
| Alloy 20 | 60.97 | 18.99 | 7.14 | 6.05 | 6.85 | — | — | — | — | — | — | — | — | — | — |
| Alloy 21 | 61.67 | 18.21 | 7.22 | 5.30 | 6.60 | 1.00 | — | — | — | — | — | — | — | — | — |
| Alloy 22 | 61.67 | 18.21 | 7.22 | 5.30 | 6.60 | — | 1.00 | — | — | — | — | — | — | — | — |
| Alloy 23 | 61.67 | 18.21 | 7.22 | 5.30 | 6.60 | — | — | 1.00 | — | — | — | — | — | — | — |
| Alloy 24 | 61.67 | 18.21 | 7.22 | 5.30 | 6.60 | — | — | — | — | — | — | 1.00 | — | — | — |
| Alloy 25 | 61.67 | 19.21 | 6.22 | 5.30 | 6.60 | — | — | — | — | 1.00 | — | — | — | — | — |
| Alloy 26 | 61.67 | 18.21 | 7.22 | 5.30 | 6.60 | — | — | — | 1.00 | | | | | | — |
| Alloy 27 | 61.67 | 19.21 | 6.22 | 5.30 | 6.60 | — | — | — | — | — | 1.00 | — | — | — | — |
| Alloy 28 | 63.08 | 15.95 | 4.54 | 5.30 | 6.60 | — | — | — | — | — | — | — | — | 4.53 | — |
| Alloy 29 | 61.10 | 19.21 | 5.85 | 5.30 | 6.60 | — | — | — | — | — | — | — | — | 1.94 | — |
| Alloy 30 | 62.11 | 20.31 | 4.26 | 5.30 | 6.60 | — | — | — | — | — | — | — | — | 1.42 | — |
| Alloy 31 | 68.70 | 15.00 | 5.00 | 5.00 | 6.30 | — | — | — | — | — | — | — | — | — | — |
| Alloy 32 | 77.05 | — | 11.05 | 5.30 | 6.60 | — | — | — | — | — | — | — | — | — | — |
| Alloy 33 | 68.72 | 7.93 | 11.45 | 5.30 | 6.60 | — | — | — | — | — | — | — | — | — | — |
| Alloy 34 | 61.67 | 19.21 | 7.22 | 5.30 | 6.60 | | | | | | | | | | |
| Alloy 35 | 76.45 | — | 11.05 | 4.70 | 7.80 | — | — | — | — | — | — | — | — | — | — |
| Alloy 36 | 75.05 | — | 11.05 | 5.30 | 6.60 | — | — | — | — | — | 2.00 | — | — | — | — |
| Alloy 37 | 72.45 | — | 15.05 | 4.70 | 7.80 | — | — | — | — | — | — | — | — | — | — |
| Alloy 38 | 72.45 | — | 13.05 | 4.70 | 7.80 | — | — | — | — | — | 2.00 | — | — | — | — |
| Alloy 39 | 73.05 | — | 7.53 | 5.30 | 6.60 | — | — | — | — | — | — | — | — | 7.52 | — |
| Alloy 40 | 72.45 | — | 7.53 | 4.70 | 7.80 | | | | | | | | | 7.52 | |
| Alloy 41 | 76.45 | — | 8.29 | 4.70 | 7.80 | — | — | — | — | — | — | — | — | 2.76 | — |
| Alloy 42 | 64.42 | 15.99 | 6.24 | 5.30 | 6.60 | — | — | — | — | — | — | — | — | 1.45 | — |
| Alloy 43 | 63.53 | 17.06 | 6.09 | 5.30 | 6.60 | — | — | — | — | — | — | — | — | 1.42 | — |
| Alloy 44 | 62.64 | 18.14 | 5.94 | 5.30 | 6.60 | — | — | — | — | — | — | 1.00 | — | 1.38 | — |
| Alloy 45 | 61.74 | 19.21 | 5.80 | 5.30 | 6.60 | — | — | — | — | — | — | — | — | 1.35 | — |
| Alloy 46 | 62.91 | 16.89 | 6.90 | 5.30 | 6.60 | — | — | — | — | — | — | — | — | 1.40 | — |
| Alloy 47 | 62.02 | 17.96 | 6.75 | 5.30 | 6.60 | — | — | — | — | — | — | 1.00 | — | 1.37 | — |
| Alloy 48 | 61.14 | 19.03 | 6.60 | 5.30 | 6.60 | — | — | — | — | — | — | 3.00 | — | 1.33 | — |
| Alloy 49 | 61.44 | 19.27 | 6.69 | 4.97 | 6.28 | — | — | — | — | — | — | 1.00 | — | 1.35 | — |
| Alloy 50 | 60.95 | 18.89 | 6.55 | 5.44 | 6.85 | — | — | — | — | — | — | — | 1.00 | 1.32 | — |
| Alloy 51 | 64.08 | 15.81 | 6.17 | 5.20 | 7.30 | — | — | — | — | — | — | — | — | 1.44 | |
| Alloy 52 | 76.53 | — | 6.18 | 5.25 | 6.71 | — | — | — | — | — | — | — | — | 5.33 | — |
| Alloy 53 | 72.98 | 3.66 | 6.16 | 5.24 | 6.71 | — | — | — | — | — | — | — | — | 5.25 | — |
| Alloy 54 | 77.23 | 3.66 | 3.52 | 5.23 | 6.73 | — | — | — | — | — | — | | | 3.63 | |
| Alloy 55 | 76.89 | 1.83 | 4.84 | 5.24 | 6.72 | — | — | — | — | — | — | — | — | 4.48 | — |
| Alloy 56 | 80.85 | — | 2.64 | 5.24 | 6.73 | — | — | — | — | — | — | — | — | 4.54 | — |
| Alloy 57 | 79.42 | 1.47 | 2.64 | 5.23 | 6.73 | — | — | — | — | — | — | — | — | 4.51 | — |
| Alloy 58 | 77.93 | 2.34 | 2.63 | 5.21 | 7.42 | — | — | — | — | — | — | — | — | 4.47 | — |
| Alloy 59 | 77.06 | 2.34 | 3.51 | 5.21 | 7.42 | — | — | — | — | — | — | — | — | 4.46 | — |
| Alloy 60 | 77.13 | 2.18 | 3.50 | 5.80 | 6.95 | — | — | — | — | — | — | — | — | 4.44 | — |
| Alloy 61 | 76.88 | 1.09 | 4.82 | 5.81 | 6.95 | — | — | — | — | — | — | — | — | 4.45 | — |
| Alloy 62 | 76.64 | — | 6.14 | 5.82 | 6.94 | — | — | — | — | — | — | — | — | 4.46 | — |
| Alloy 63 | 74.93 | — | 6.14 | 5.81 | 6.94 | — | — | — | — | — | — | — | — | 6.18 | — |
| Alloy 64 | 73.54 | 5.08 | 2.53 | 5.78 | 6.96 | — | — | — | — | — | — | — | — | 6.11 | — |
| Alloy 65 | 60.74 | 19.43 | 6.60 | 5.30 | 6.60 | — | — | — | — | — | — | — | — | 1.33 | — |
| Alloy 66 | 61.44 | 18.73 | 6.60 | 5.30 | 6.60 | — | — | — | — | — | — | — | — | 1.33 | — |
| Alloy 67 | 60.79 | 19.03 | 6.95 | 5.30 | 6.60 | — | — | — | — | — | — | — | — | 1.33 | — |
| Alloy 68 | 61.49 | 19.03 | 6.25 | 5.30 | 6.60 | — | — | — | — | — | — | — | — | 1.33 | — |
| Alloy 69 | 61.44 | 19.03 | 6.60 | 5.30 | 6.60 | — | — | — | — | — | — | — | — | 1.03 | — |
| Alloy 70 | 60.74 | 19.03 | 6.60 | 5.30 | 6.60 | — | — | — | — | — | — | — | — | 1.73 | — |
| Alloy 71 | 61.64 | 19.03 | 6.60 | 4.80 | 6.60 | — | — | — | — | — | — | — | — | 1.33 | — |
| Alloy 72 | 60.49 | 19.03 | 6.60 | 5.95 | 6.60 | — | — | — | — | — | — | — | — | 1.33 | — |
| Alloy 73 | 61.64 | 19.03 | 6.60 | 5.30 | 6.10 | — | — | — | — | — | — | — | — | 1.33 | — |
| Alloy 74 | 60.74 | 19.03 | 6.60 | 5.30 | 7.00 | — | — | — | — | — | — | — | — | 1.33 | — |
| Alloy 75 | 72.45 | — | 8.29 | 4.70 | 7.80 | — | — | — | — | — | — | — | — | 6.76 | — |
| Alloy 76 | 72.45 | — | 9.79 | 4.70 | 7.80 | — | — | — | — | — | — | — | — | 5.26 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 77 | 76.45 | — | 8.29 | 4.70 | 7.80 | — | — | — | — | — | — | — | — | 2.76 | — |
| Alloy 78 | 77.05 | — | 8.29 | 5.30 | 6.60 | — | — | — | — | — | — | — | — | 2.76 | — |
| Alloy 79 | 77.65 | — | 8.29 | 3.50 | 7.80 | — | — | — | — | — | — | — | — | 2.76 | — |
| Alloy 80 | 74.87 | 2.18 | 8.29 | 5.30 | 6.60 | — | — | — | — | — | — | — | — | 2.76 | — |
| Alloy 81 | 74.27 | 2.18 | 8.29 | 4.70 | 7.80 | — | — | — | — | — | — | — | — | 2.76 | |
| Alloy 82 | 61.30 | 18.90 | 6.80 | 5.50 | 6.60 | — | — | — | — | — | — | — | — | 0.90 | — |
| Alloy 83 | 60.69 | 18.71 | 6.73 | 5.45 | 6.53 | — | — | — | — | — | — | — | — | 0.89 | 1.00 |
| Alloy 84 | 60.08 | 18.52 | 6.66 | 5.39 | 6.47 | — | — | — | — | — | — | — | — | 0.88 | 2.00 |
| Alloy 85 | 61.85 | 18.90 | 6.80 | 5.40 | 6.60 | — | — | — | — | — | — | — | — | 0.45 | — |
| Alloy 86 | 62.30 | 18.90 | 6.80 | 5.40 | 6.60 | — | — | — | — | — | — | — | — | — | — |
| Alloy 87 | 61.00 | 18.90 | 6.80 | 5.80 | 6.60 | — | — | — | — | — | — | — | — | 0.90 | — |
| Alloy 88 | 74.45 | — | 8.29 | 4.70 | 7.80 | — | — | — | — | — | — | — | — | 4.76 | — |
| Alloy 89 | 75.05 | — | 8.29 | 4.10 | 7.80 | — | — | — | — | — | — | — | — | 4.76 | — |
| Alloy 90 | 75.65 | — | 8.29 | 3.50 | 7.80 | — | — | — | — | — | — | — | — | 4.76 | — |
| Alloy 91 | 73.05 | — | 8.29 | 4.10 | 7.80 | — | — | — | — | — | — | — | — | 6.76 | — |
| Alloy 92 | 73.65 | — | 8.29 | 3.50 | 7.80 | — | — | — | — | — | — | — | — | 6.76 | — |
| Alloy 93 | 74.85 | — | 8.29 | 3.50 | 6.60 | — | — | — | — | — | — | — | — | 6.76 | — |
| Alloy 94 | 72.15 | — | 8.59 | 4.70 | 7.80 | — | — | — | — | — | — | — | — | 6.76 | — |
| Alloy 95 | 72.75 | — | 8.59 | 4.10 | 7.80 | — | — | — | — | — | — | — | — | 6.76 | — |
| Alloy 96 | 73.35 | — | 8.59 | 3.50 | 7.80 | — | — | — | — | — | — | — | — | 6.76 | — |
| Alloy 97 | 72.75 | — | 7.99 | 4.70 | 7.80 | — | — | — | — | — | — | — | — | 6.76 | — |
| Alloy 98 | 73.35 | — | 7.99 | 4.10 | 7.80 | — | — | — | — | — | — | — | — | 6.76 | — |
| Alloy 99 | 73.95 | — | 7.99 | 3.50 | 7.80 | — | — | — | — | — | — | — | — | 6.76 | — |
| Alloy 100 | 73.25 | — | 8.29 | 4.70 | 7.00 | — | — | — | — | — | — | — | — | 6.76 | — |
| Alloy 101 | 71.65 | — | 8.29 | 4.70 | 8.60 | — | — | — | — | — | — | — | — | 6.76 | — |
| Alloy 102 | 72.45 | — | 8.29 | 4.70 | 7.80 | — | — | — | — | — | — | — | — | 6.76 | — |
| Alloy 103 | 72.45 | — | 9.79 | 4.70 | 7.80 | — | — | — | — | — | — | — | — | 5.26 | — |
| Alloy 104 | 76.45 | — | 8.29 | 4.70 | 7.80 | — | — | — | — | — | — | — | — | 2.76 | — |
| Alloy 105 | 77.05 | — | 8.29 | 5.30 | 6.60 | — | — | — | — | — | — | — | — | 2.76 | — |
| Alloy 106 | 77.65 | — | 8.29 | 3.50 | 7.80 | — | — | — | — | — | — | — | — | 2.76 | — |
| Alloy 107 | 74.87 | 2.18 | 8.29 | 5.30 | 6.60 | — | — | — | — | — | — | — | — | 2.76 | — |
| Alloy 108 | 74.27 | 2.18 | 8.29 | 4.70 | 7.80 | — | — | — | — | — | — | — | — | 2.76 | — |
| Alloy 109 | 71.75 | — | 8.59 | 4.70 | 7.80 | — | — | — | — | — | — | — | — | 7.16 | — |
| Alloy 110 | 71.35 | — | 8.59 | 4.70 | 7.80 | — | — | — | — | — | — | — | — | 7.56 | — |
| Alloy 111 | 70.95 | — | 8.59 | 4.70 | 7.80 | — | — | — | — | — | — | — | — | 7.96 | — |
| Alloy 112 | 72.15 | — | 8.19 | 4.70 | 7.80 | — | — | — | — | — | — | — | — | 7.16 | — |
| Alloy 113 | 72.15 | — | 7.79 | 4.70 | 7.80 | — | — | — | — | — | — | — | — | 7.56 | — |
| Alloy 114 | 72.15 | — | 7.39 | 4.70 | 7.80 | — | — | — | — | — | — | — | — | 7.96 | — |
| Alloy 115 | 72.55 | — | 8.59 | 4.70 | 7.40 | — | — | — | — | — | — | — | — | 6.76 | — |
| Alloy 116 | 71.75 | — | 8.59 | 5.10 | 7.80 | — | — | — | — | — | — | — | — | 6.76 | — |
| Alloy 117 | 72.15 | — | 8.59 | 5.10 | 7.40 | — | — | — | — | — | — | — | — | 6.76 | — |
| Alloy 118 | 73.15 | — | 8.59 | 4.10 | 7.40 | — | — | — | — | — | — | — | — | 6.76 | — |
| Alloy 119 | 69.52 | 1.79 | 5.28 | 4.78 | 7.35 | — | — | — | — | — | — | — | — | 11.28 | — |
| Alloy 120 | 67.59 | 1.78 | 3.51 | 4.77 | 7.34 | — | — | — | — | — | — | — | — | 15.01 | — |
| Alloy 121 | 65.64 | 1.78 | 1.75 | 4.76 | 7.33 | — | — | — | — | — | — | — | — | 18.74 | — |
| Alloy 122 | 69.85 | 3.37 | 5.27 | 4.77 | 7.35 | — | — | — | — | — | — | — | — | 9.39 | — |
| Alloy 123 | 67.88 | 3.37 | 3.51 | 4.77 | 7.34 | — | — | — | — | — | — | — | — | 13.13 | — |
| Alloy 124 | 65.95 | 3.36 | 1.75 | 4.76 | 7.33 | — | — | — | — | — | — | — | — | 16.85 | — |
| Alloy 125 | 70.15 | 4.96 | 5.27 | 4.77 | 7.34 | — | — | — | — | — | — | — | — | 7.51 | — |
| Alloy 126 | 68.21 | 4.95 | 3.51 | 4.76 | 7.33 | — | — | — | — | — | — | — | — | 11.24 | — |
| Alloy 127 | 66.27 | 4.94 | 1.75 | 4.75 | 7.32 | — | — | — | — | — | — | — | — | 14.97 | — |
| Alloy 128 | 70.46 | 6.54 | 5.27 | 4.76 | 7.34 | — | — | — | — | — | — | — | — | 5.63 | — |
| Alloy 129 | 68.51 | 6.53 | 3.51 | 4.76 | 7.33 | — | — | — | — | — | — | — | — | 9.36 | — |
| Alloy 130 | 66.58 | 6.52 | 1.75 | 4.75 | 7.31 | — | — | — | — | — | — | — | — | 13.09 | — |
| Alloy 131 | 70.78 | 8.12 | 5.26 | 4.76 | 7.33 | — | — | — | — | — | — | — | — | 3.75 | — |
| Alloy 132 | 68.85 | 8.10 | 3.50 | 4.75 | 7.32 | — | — | — | — | — | — | — | — | 7.48 | — |
| Alloy 133 | 66.89 | 8.09 | 1.75 | 4.75 | 7.31 | — | — | — | — | — | — | — | — | 11.21 | — |
| Alloy 134 | 65.86 | 6.93 | 4.82 | 4.76 | 7.33 | — | — | — | — | — | — | — | — | 10.30 | — |
| Alloy 135 | 64.41 | 6.92 | 3.50 | 4.75 | 7.32 | — | — | — | — | — | — | — | — | 13.10 | — |
| Alloy 136 | 62.96 | 6.91 | 2.19 | 4.75 | 7.31 | — | — | — | — | — | — | — | — | 15.88 | — |
| Alloy 137 | 68.70 | 5.94 | 4.83 | 4.76 | 7.33 | — | — | — | — | — | — | — | — | 8.44 | — |
| Alloy 138 | 67.22 | 5.94 | 3.51 | 4.76 | 7.33 | — | — | — | — | — | — | — | — | 11.24 | — |
| Alloy 139 | 65.78 | 5.93 | 2.19 | 4.75 | 7.32 | — | — | — | — | — | — | — | — | 14.03 | — |
| Alloy 140 | 66.77 | 7.91 | 4.82 | 4.76 | 7.32 | — | — | — | — | — | — | — | — | 8.42 | — |
| Alloy 141 | 65.31 | 7.90 | 3.50 | 4.75 | 7.32 | — | — | — | — | — | — | — | — | 11.22 | — |
| Alloy 142 | 63.85 | 7.89 | 2.19 | 4.75 | 7.31 | — | — | — | — | — | — | — | — | 14.01 | — |
| Alloy 143 | 71.53 | 4.96 | 4.83 | 4.77 | 7.34 | — | — | — | — | — | — | — | — | 6.57 | — |
| Alloy 144 | 70.08 | 4.95 | 3.51 | 4.76 | 7.33 | — | — | — | — | — | — | — | — | 9.37 | — |
| Alloy 145 | 68.61 | 4.95 | 2.19 | 4.76 | 7.32 | — | — | — | — | — | — | — | — | 12.17 | — |
| Alloy 146 | 69.60 | 6.93 | 4.82 | 4.76 | 7.33 | — | — | — | — | — | — | — | — | 6.56 | — |
| Alloy 147 | 68.14 | 6.92 | 3.50 | 4.76 | 7.32 | — | — | — | — | — | — | — | — | 9.36 | — |
| Alloy 148 | 66.69 | 6.91 | 2.19 | 4.75 | 7.31 | — | — | — | — | — | — | — | — | 12.15 | — |
| Alloy 149 | 67.65 | 8.90 | 4.82 | 4.76 | 7.32 | — | — | — | — | — | — | — | — | 6.55 | — |
| Alloy 150 | 66.20 | 8.89 | 3.50 | 4.75 | 7.31 | — | — | — | — | — | — | — | — | 9.35 | — |
| Alloy 151 | 64.76 | 8.88 | 2.18 | 4.74 | 7.30 | — | — | — | — | — | — | — | — | 12.14 | — |
| Alloy 152 | 72.42 | 5.95 | 4.83 | 4.77 | 7.34 | — | — | — | — | — | — | — | — | 4.69 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 153 | 70.97 | 5.94 | 3.51 | 4.76 | 7.33 | — | — | — | — | — | — | — | — | 7.49 | — |
| Alloy 154 | 69.51 | 5.93 | 2.19 | 4.76 | 7.32 | — | — | — | — | — | — | — | — | 10.29 | — |
| Alloy 155 | 73.33 | 6.93 | 4.83 | 4.76 | 7.34 | — | — | — | — | — | — | — | — | 2.81 | — |
| Alloy 156 | 71.85 | 6.93 | 3.51 | 4.76 | 7.33 | — | — | — | — | — | — | — | — | 5.62 | — |
| Alloy 157 | 70.40 | 6.92 | 2.19 | 4.75 | 7.32 | — | — | — | — | — | — | — | — | 8.42 | — |
| Alloy 158 | 59.35 | 18.87 | 5.06 | 5.51 | 6.60 | — | — | — | — | — | — | — | — | 4.61 | — |
| Alloy 159 | 57.45 | 18.84 | 3.32 | 5.50 | 6.59 | — | — | — | — | — | — | — | — | 8.30 | — |
| Alloy 160 | 55.56 | 18.81 | 1.58 | 5.49 | 6.58 | — | — | — | — | — | — | — | — | 11.98 | — |
| Alloy 161 | 60.70 | 12.70 | 4.94 | 5.39 | 11.77 | — | — | — | — | — | — | — | — | 4.50 | — |
| Alloy 162 | 58.84 | 12.68 | 3.24 | 5.38 | 11.75 | — | — | — | — | — | — | — | — | 8.11 | — |
| Alloy 163 | 56.98 | 12.66 | 1.55 | 5.37 | 11.73 | — | — | — | — | — | — | — | — | 11.71 | — |
| Alloy 164 | 65.10 | 13.05 | 5.08 | 5.53 | 6.62 | — | — | — | — | — | — | — | — | 4.62 | — |
| Alloy 165 | 63.18 | 13.03 | 3.33 | 5.52 | 6.61 | — | — | — | — | — | — | — | — | 8.33 | — |
| Alloy 166 | 61.24 | 13.01 | 1.59 | 5.52 | 6.61 | — | — | — | — | — | — | — | — | 12.03 | — |
| Alloy 167 | 67.21 | 4.95 | 3.51 | 5.76 | 7.33 | — | — | — | — | — | — | — | — | 11.24 | — |
| Alloy 168 | 69.21 | 4.95 | 3.51 | 3.76 | 7.33 | — | — | — | — | — | — | — | — | 11.24 | — |
| Alloy 169 | 69.21 | 4.95 | 3.51 | 4.76 | 6.33 | — | — | — | — | — | — | — | — | 11.24 | — |
| Alloy 170 | 70.21 | 4.95 | 3.51 | 3.76 | 6.33 | — | — | — | — | — | — | — | — | 11.24 | — |
| Alloy 171 | 69.66 | 3.50 | 3.51 | 4.76 | 7.33 | — | — | — | — | — | — | — | — | 11.24 | — |
| Alloy 172 | 66.21 | 4.95 | 3.51 | 4.76 | 7.33 | — | — | — | — | — | 2.00 | — | — | 11.24 | — |
| Alloy 173 | 66.71 | 4.95 | 3.51 | 4.76 | 7.33 | — | — | — | — | — | — | — | — | 11.24 | 1.50 |
| Alloy 174 | 66.65 | 8.90 | 4.82 | 5.76 | 7.32 | — | — | — | — | — | — | — | — | 6.55 | — |
| Alloy 175 | 68.65 | 8.90 | 4.82 | 3.76 | 7.32 | — | — | — | — | — | — | — | — | 6.55 | — |
| Alloy 176 | 68.65 | 8.90 | 4.82 | 4.76 | 6.32 | — | — | — | — | — | — | — | — | 6.55 | — |
| Alloy 177 | 69.65 | 8.90 | 4.82 | 3.76 | 6.32 | — | — | — | — | — | — | — | — | 6.55 | — |
| Alloy 178 | 71.60 | 4.95 | 4.82 | 4.76 | 7.32 | — | — | — | — | — | — | — | — | 6.55 | — |
| Alloy 179 | 73.05 | 3.50 | 4.82 | 4.76 | 7.32 | — | — | — | — | — | — | — | — | 6.55 | — |
| Alloy 180 | 65.65 | 8.90 | 4.82 | 4.76 | 7.32 | — | — | — | — | — | 2.00 | — | — | 6.55 | — |
| Alloy 181 | 66.15 | 8.90 | 4.82 | 4.76 | 7.32 | — | — | — | — | — | — | — | — | 6.55 | 1.50 |
| Alloy 182 | 67.73 | 4.95 | 3.51 | 4.76 | 7.33 | — | — | — | — | — | 2.00 | — | — | 9.72 | — |
| Alloy 183 | 65.21 | 4.95 | 3.51 | 4.76 | 7.33 | — | — | — | — | — | 3.00 | — | — | 11.24 | — |
| Alloy 184 | 67.49 | 4.95 | 3.51 | 4.76 | 7.33 | — | — | — | — | — | 3.00 | — | — | 8.96 | — |
| Alloy 185 | 70.32 | 4.95 | 4.10 | 4.76 | 7.32 | — | — | — | — | — | 2.00 | — | — | 6.55 | — |
| Alloy 186 | 68.60 | 4.95 | 4.82 | 4.76 | 7.32 | — | — | — | — | — | 3.00 | — | — | 6.55 | — |
| Alloy 187 | 69.68 | 4.95 | 3.74 | 4.76 | 7.32 | — | — | — | — | — | 3.00 | — | — | 6.55 | — |
| Alloy 188 | 68.73 | 4.95 | 3.51 | 3.76 | 7.33 | — | — | — | — | — | 2.00 | — | — | 9.72 | — |
| Alloy 189 | 66.21 | 4.95 | 3.51 | 3.76 | 7.33 | — | — | — | — | — | 3.00 | — | — | 11.24 | — |
| Alloy 190 | 68.49 | 4.95 | 3.51 | 3.76 | 7.33 | — | — | — | — | — | 3.00 | — | — | 8.96 | — |
| Alloy 191 | 71.32 | 4.95 | 4.10 | 3.76 | 7.32 | — | — | — | — | — | 2.00 | — | — | 6.55 | — |
| Alloy 192 | 69.60 | 4.95 | 4.82 | 3.76 | 7.32 | — | — | — | — | — | 3.00 | — | — | 6.55 | — |
| Alloy 193 | 70.68 | 4.95 | 3.74 | 3.76 | 7.32 | — | — | — | — | — | 3.00 | — | — | 6.55 | — |
| Alloy 194 | 67.21 | 4.95 | 3.51 | 3.76 | 7.33 | — | — | — | — | — | 2.00 | — | — | 11.24 | — |
| Alloy 195 | 71.32 | 4.95 | 4.10 | 3.76 | 7.32 | — | — | — | — | — | 2.00 | — | — | 6.55 | — |
| Alloy 196 | 69.60 | 4.95 | 4.82 | 3.76 | 7.32 | — | — | — | — | — | 3.00 | — | — | 6.55 | — |
| Alloy 197 | 70.68 | 4.95 | 3.74 | 3.76 | 7.32 | — | — | — | — | — | 3.00 | — | — | 6.55 | — |
| Alloy 198 | 71.82 | 4.95 | 4.10 | 3.26 | 7.32 | — | — | — | — | — | 2.00 | — | — | 6.55 | — |
| Alloy 199 | 70.10 | 4.95 | 4.82 | 3.26 | 7.32 | — | — | — | — | — | 3.00 | — | — | 6.55 | — |
| Alloy 200 | 71.18 | 4.95 | 3.74 | 3.26 | 7.32 | — | — | — | — | — | 3.00 | — | — | 6.55 | — |
| Alloy 201 | 72.32 | 4.95 | 4.10 | 2.76 | 7.32 | — | — | — | — | — | 2.00 | — | — | 6.55 | — |
| Alloy 202 | 70.60 | 4.95 | 4.82 | 2.76 | 7.32 | — | — | — | — | — | 3.00 | — | — | 6.55 | — |
| Alloy 203 | 71.68 | 4.95 | 3.74 | 2.76 | 7.32 | — | — | — | — | — | 3.00 | — | — | 6.55 | — |
| Alloy 204 | 72.82 | 3.45 | 4.10 | 3.76 | 7.32 | — | — | — | — | — | 2.00 | — | — | 6.55 | — |
| Alloy 205 | 71.10 | 3.45 | 4.82 | 3.76 | 7.32 | — | — | — | — | — | 3.00 | — | — | 6.55 | — |
| Alloy 206 | 72.18 | 3.45 | 3.74 | 3.76 | 7.32 | — | — | — | — | — | 3.00 | — | — | 6.55 | — |
| Alloy 207 | 70.32 | 4.95 | 4.10 | 3.76 | 7.32 | — | — | — | — | — | 3.00 | — | — | 6.55 | — |
| Alloy 208 | 71.82 | 4.95 | 4.10 | 3.76 | 7.32 | — | — | — | — | — | 1.50 | — | — | 6.55 | — |
| Alloy 209 | 71.10 | 4.95 | 4.82 | 3.76 | 7.32 | — | — | — | — | — | 1.50 | — | — | 6.55 | — |
| Alloy 210 | 72.18 | 4.95 | 3.74 | 3.76 | 7.32 | — | — | — | — | — | 1.50 | — | — | 6.55 | — |
| Alloy 211 | 71.82 | 4.95 | 4.10 | 3.76 | 7.32 | — | — | — | — | — | 2.00 | — | — | 6.05 | — |
| Alloy 212 | 72.32 | 4.95 | 4.10 | 3.76 | 7.32 | — | — | — | — | — | 2.00 | — | — | 5.55 | — |
| Alloy 213 | 71.62 | 4.95 | 4.10 | 3.76 | 7.02 | — | — | — | — | — | 2.00 | — | — | 6.55 | — |
| Alloy 214 | 71.92 | 4.95 | 4.10 | 3.76 | 6.72 | — | — | — | — | — | 2.00 | — | — | 6.55 | — |
| Alloy 215 | 72.12 | 4.95 | 4.10 | 3.76 | 7.02 | — | — | — | — | — | 2.00 | — | — | 6.05 | — |
| Alloy 216 | 60.47 | 19.43 | 6.60 | 5.29 | 6.60 | — | — | — | — | — | 0.28 | — | — | 1.33 | — |
| Alloy 217 | 69.62 | 4.95 | 2.10 | 3.76 | 7.02 | — | — | — | — | — | 2.00 | — | — | 10.55 | — |
| Alloy 218 | 70.62 | 4.95 | 2.10 | 3.76 | 7.02 | — | — | — | — | — | 2.00 | — | — | 9.55 | — |
| Alloy 219 | 71.62 | 4.95 | 2.10 | 3.76 | 7.02 | — | — | — | — | — | 2.00 | — | — | 8.55 | — |
| Alloy 220 | 72.62 | 4.95 | 2.10 | 3.76 | 7.02 | — | — | — | — | — | 2.00 | — | — | 7.55 | — |
| Alloy 221 | 69.62 | 4.95 | 2.10 | 3.76 | 7.02 | — | — | — | — | — | 6.00 | — | — | 6.55 | — |
| Alloy 222 | 70.62 | 4.95 | 2.10 | 3.76 | 7.02 | — | — | — | — | — | 5.00 | — | — | 6.55 | — |
| Alloy 223 | 71.62 | 4.95 | 2.10 | 3.76 | 7.02 | — | — | — | — | — | 4.00 | — | — | 6.55 | — |
| Alloy 224 | 72.62 | 4.95 | 2.10 | 3.76 | 7.02 | — | — | — | — | — | 3.00 | — | — | 6.55 | — |
| Alloy 225 | 69.62 | 6.95 | 2.10 | 3.76 | 7.02 | — | — | — | — | — | 2.00 | — | — | 8.55 | — |
| Alloy 226 | 73.62 | 2.95 | 2.10 | 3.76 | 7.02 | — | — | — | — | — | 2.00 | — | — | 8.55 | — |
| Alloy 227 | 71.12 | 4.95 | 2.60 | 3.76 | 7.02 | — | — | — | — | — | 2.00 | — | — | 8.55 | — |
| Alloy 228 | 72.12 | 4.95 | 1.60 | 3.76 | 7.02 | — | — | — | — | — | 2.00 | — | — | 8.55 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 229 | 71.12 | 4.95 | 2.10 | 4.26 | 7.02 | — | — | — | — | — | 2.00 | — | — | 8.55 | — |
| Alloy 230 | 72.12 | 4.95 | 2.10 | 3.26 | 7.02 | — | — | — | — | — | 2.00 | — | — | 8.55 | — |
| Alloy 231 | 70.92 | 4.95 | 2.10 | 3.76 | 7.72 | — | — | — | — | — | 2.00 | — | — | 8.55 | — |
| Alloy 232 | 72.32 | 4.95 | 2.10 | 3.76 | 6.32 | — | — | — | — | — | 2.00 | — | — | 8.55 | — |
| Alloy 233 | 71.12 | 4.95 | 2.10 | 3.76 | 7.02 | — | — | — | — | — | 2.50 | — | — | 8.55 | — |
| Alloy 234 | 72.12 | 4.95 | 2.10 | 3.76 | 7.02 | — | — | — | — | — | 1.50 | — | — | 8.55 | — |
| Alloy 235 | 70.12 | 4.95 | 1.60 | 3.76 | 7.02 | — | — | — | — | — | 2.00 | — | — | 10.55 | — |
| Alloy 236 | 70.62 | 4.95 | 1.10 | 3.76 | 7.02 | — | — | — | — | — | 2.00 | — | — | 10.55 | — |
| Alloy 237 | 66.62 | 7.95 | 2.10 | 3.76 | 7.02 | — | — | — | — | — | 2.00 | — | — | 10.55 | — |
| Alloy 238 | 68.12 | 6.45 | 2.10 | 3.76 | 7.02 | — | — | — | — | — | 2.00 | — | — | 10.55 | — |
| Alloy 239 | 68.22 | 4.95 | 2.10 | 3.76 | 8.42 | — | — | — | — | — | 2.00 | — | — | 10.55 | — |
| Alloy 240 | 68.92 | 4.95 | 2.10 | 3.76 | 7.72 | — | — | — | — | — | 2.00 | — | — | 10.55 | — |
| Alloy 241 | 68.62 | 4.95 | 2.10 | 3.76 | 7.02 | — | — | — | — | — | 3.00 | — | — | 10.55 | — |
| Alloy 242 | 70.62 | 4.95 | 2.10 | 3.76 | 7.02 | — | — | — | — | — | 1.00 | — | — | 10.55 | — |
| Alloy 243 | 69.12 | 4.95 | 1.60 | 3.76 | 7.02 | — | — | — | — | — | 3.00 | — | — | 10.55 | — |
| Alloy 244 | 69.62 | 4.95 | 1.10 | 3.76 | 7.02 | — | — | — | — | — | 3.00 | — | — | 10.55 | — |
| Alloy 245 | 59.97 | 7.36 | — | 5.43 | 6.80 | — | — | — | — | — | — | — | — | 20.44 | — |
| Alloy 246 | 60.80 | 3.63 | — | 5.35 | 10.07 | — | — | — | — | — | — | — | — | 20.15 | — |
| Alloy 247 | 61.60 | — | — | 5.28 | 13.25 | — | — | — | — | — | — | — | — | 19.87 | — |
| Alloy 248 | 61.87 | 5.41 | — | 5.44 | 6.81 | — | — | — | — | — | — | — | — | 20.47 | — |
| Alloy 249 | 62.48 | 2.67 | — | 5.38 | 9.22 | — | — | — | — | — | — | — | — | 20.25 | — |
| Alloy 250 | 63.02 | — | — | 5.32 | 11.62 | — | — | — | — | — | — | — | — | 20.04 | — |
| Alloy 251 | 63.79 | 3.45 | — | 5.44 | 6.82 | — | — | — | — | — | — | — | — | 20.50 | — |
| Alloy 252 | 64.19 | 1.71 | — | 5.41 | 8.33 | — | — | — | — | — | — | — | — | 20.36 | — |
| Alloy 253 | 64.49 | — | — | 5.37 | 9.92 | — | — | — | — | — | — | — | — | 20.22 | — |
| Alloy 254 | 63.67 | 7.37 | — | 5.43 | 6.80 | — | — | — | — | — | — | — | — | 16.73 | — |
| Alloy 255 | 64.44 | 3.63 | — | 5.36 | 10.07 | — | — | — | — | — | — | — | — | 16.50 | — |
| Alloy 256 | 65.20 | — | — | 5.28 | 13.26 | — | — | — | — | — | — | — | — | 16.26 | — |
| Alloy 257 | 65.58 | 5.41 | — | 5.44 | 6.81 | — | — | — | — | — | — | — | — | 16.76 | — |
| Alloy 258 | 66.13 | 2.68 | — | 5.38 | 9.23 | — | — | — | — | — | — | — | — | 16.58 | — |
| Alloy 259 | 66.64 | — | — | 5.33 | 11.62 | — | — | — | — | — | — | — | — | 16.41 | — |
| Alloy 260 | 67.50 | 3.45 | — | 5.45 | 6.82 | — | — | — | — | — | — | — | — | 16.78 | — |
| Alloy 261 | 67.88 | 1.71 | — | 5.41 | 8.33 | — | — | — | — | — | — | — | — | 16.67 | — |
| Alloy 262 | 68.15 | — | — | 5.37 | 9.93 | — | — | — | — | — | — | — | — | 16.55 | — |
| Alloy 263 | 67.36 | 7.37 | — | 5.44 | 6.81 | — | — | — | — | — | — | — | — | 13.02 | — |
| Alloy 264 | 68.09 | 3.63 | — | 5.36 | 10.08 | — | — | — | — | — | — | — | — | 12.84 | — |
| Alloy 265 | 68.80 | — | — | 5.28 | 13.26 | — | — | — | — | — | — | — | — | 12.66 | — |
| Alloy 266 | 69.30 | 5.41 | — | 5.44 | 6.81 | — | — | — | — | — | — | — | — | 13.04 | — |
| Alloy 267 | 69.80 | 2.68 | — | 5.39 | 9.23 | — | — | — | — | — | — | — | — | 12.90 | — |
| Alloy 268 | 70.27 | — | — | 5.33 | 11.63 | — | — | — | — | — | — | — | — | 12.77 | — |
| Alloy 269 | 71.22 | 3.45 | — | 5.45 | 6.82 | — | — | — | — | — | — | — | — | 13.06 | — |
| Alloy 270 | 71.56 | 1.71 | — | 5.42 | 8.34 | — | — | — | — | — | — | — | — | 12.97 | — |
| Alloy 271 | 71.81 | — | — | 5.38 | 9.93 | — | — | — | — | — | — | — | — | 12.88 | — |
| Alloy 272 | 59.70 | 18.00 | 6.80 | 5.50 | 6.60 | — | 2.50 | — | — | — | — | — | — | 0.90 | — |
| Alloy 273 | 57.20 | 21.00 | 6.80 | 5.50 | 6.60 | — | 2.00 | — | — | — | — | — | — | 0.90 | — |
| Alloy 274 | 55.20 | 23.50 | 6.80 | 5.50 | 6.60 | — | 1.50 | — | — | — | — | — | — | 0.90 | — |
| Alloy 275 | 53.20 | 26.00 | 6.80 | 5.50 | 6.60 | — | 1.00 | — | — | — | — | — | — | 0.90 | — |
| Alloy 276 | 50.70 | 29.00 | 6.80 | 5.50 | 6.60 | — | 0.50 | — | — | — | — | — | — | 0.90 | — |
| Alloy 277 | 48.20 | 32.00 | 6.80 | 5.50 | 6.60 | — | — | — | — | — | — | — | — | 0.90 | — |
| Alloy 278 | 65.62 | 7.95 | 2.10 | 4.76 | 7.02 | — | — | — | — | — | 2.00 | — | — | 10.55 | — |
| Alloy 279 | 66.62 | 6.95 | 2.10 | 4.76 | 7.02 | — | — | — | — | — | 2.00 | — | — | 10.55 | — |
| Alloy 280 | 67.62 | 5.95 | 2.10 | 4.76 | 7.02 | — | — | — | — | — | 2.00 | — | — | 10.55 | — |
| Alloy 281 | 65.42 | 7.95 | 2.10 | 4.26 | 7.72 | — | — | — | — | — | 2.00 | — | — | 10.55 | — |
| Alloy 282 | 66.42 | 6.95 | 2.10 | 4.26 | 7.72 | — | — | — | — | — | 2.00 | — | — | 10.55 | — |
| Alloy 283 | 67.42 | 5.95 | 2.10 | 4.26 | 7.72 | — | — | — | — | — | 2.00 | — | — | 10.55 | — |
| Alloy 284 | 68.97 | 7.95 | 1.25 | 4.76 | 5.52 | — | — | — | — | — | 1.00 | — | — | 10.55 | — |
| Alloy 285 | 69.47 | 6.95 | 1.25 | 4.76 | 6.02 | — | — | — | — | — | 1.00 | — | — | 10.55 | — |
| Alloy 286 | 69.97 | 5.95 | 1.25 | 4.76 | 6.52 | — | — | — | — | — | 1.00 | — | — | 10.55 | — |
| Alloy 287 | 71.67 | 3.55 | 1.25 | 4.26 | 7.72 | — | — | — | — | — | 1.00 | — | — | 10.55 | — |
| Alloy 288 | 72.17 | 3.05 | 1.25 | 4.26 | 7.72 | — | — | — | — | — | 1.00 | — | — | 10.55 | |
| Alloy 289 | 72.37 | 3.55 | 1.25 | 4.26 | 7.02 | — | — | — | — | — | 1.00 | — | — | 10.55 | |
| Alloy 290 | 69.22 | 4.95 | 1.75 | 3.76 | 7.77 | — | — | — | — | — | 2.00 | — | — | 10.55 | |
| Alloy 291 | 69.27 | 4.95 | 2.10 | 3.76 | 7.77 | — | — | — | — | — | 1.60 | — | — | 10.55 | |
| Alloy 292 | 68.02 | 4.95 | 2.10 | 4.61 | 7.77 | — | — | — | — | — | 2.00 | — | — | 10.55 | — |
| Alloy 293 | 68.29 | 5.53 | 2.10 | 3.76 | 7.77 | — | — | — | — | — | 2.00 | — | — | 10.55 | — |
| Alloy 294 | 68.43 | 4.95 | 2.10 | 3.76 | 7.77 | — | — | — | — | — | 2.00 | — | — | 10.99 | — |
| Alloy 295 | 69.31 | 4.95 | 2.10 | 3.76 | 7.77 | — | — | — | — | — | 2.00 | — | — | 10.11 | — |
| Alloy 296 | 68.52 | 4.95 | 2.45 | 3.76 | 7.77 | — | — | — | — | — | 2.00 | — | — | 10.55 | — |
| Alloy 297 | 68.17 | 4.95 | 2.80 | 3.76 | 7.77 | — | — | — | — | — | 2.00 | — | — | 10.55 | — |
| Alloy 298 | 68.37 | 4.95 | 2.10 | 3.76 | 7.77 | — | — | — | — | — | 2.50 | — | — | 10.55 | — |
| Alloy 299 | 72.20 | 4.37 | 2.10 | 3.76 | 7.02 | — | — | — | — | — | 2.00 | — | — | 8.55 | — |
| Alloy 300 | 71.27 | 4.95 | 2.45 | 3.76 | 7.02 | — | — | — | — | — | 2.00 | — | — | 8.55 | — |
| Alloy 301 | 72.06 | 4.95 | 2.10 | 3.76 | 7.02 | — | — | — | — | — | 2.00 | — | — | 8.11 | — |
| Alloy 302 | 70.77 | 4.95 | 2.10 | 4.61 | 7.02 | — | — | — | — | — | 2.00 | — | — | 8.55 | — |
| Alloy 303 | 70.97 | 4.95 | 2.10 | 3.76 | 7.67 | — | — | — | — | — | 2.00 | — | — | 8.55 | — |
| Alloy 304 | 70.62 | 4.95 | 2.10 | 3.76 | 7.02 | — | — | — | — | — | 3.00 | — | — | 8.55 | — |

TABLE 2-continued

| Chemical Composition of the Alloys (atomic %) | | | | | | | | | | | | | | | |
|---|---|---|---|---|---|---|---|---|---|---|---|---|---|---|---|
| Alloy | Fe | Cr | Ni | B | Si | W | Mo | Nb | Ti | Al | Cu | V | Zr | Mn | C |
| Alloy 305 | 70.69 | 4.66 | 2.28 | 4.19 | 7.35 | — | — | — | — | — | 2.50 | — | — | 8.33 | — |
| Alloy 306 | 70.19 | 5.53 | 2.10 | 4.61 | 7.02 | — | — | — | — | — | 2.00 | — | — | 8.55 | — |
| Alloy 307 | 71.12 | 4.95 | 1.75 | 4.61 | 7.02 | — | — | — | — | — | 2.00 | — | — | 8.55 | — |
| Alloy 308 | 70.42 | 4.95 | 2.45 | 4.61 | 7.02 | — | — | — | — | — | 2.00 | — | — | 8.55 | — |
| Alloy 309 | 71.65 | 4.95 | 2.10 | 4.61 | 7.02 | — | — | — | — | — | 2.00 | — | — | 7.67 | — |
| Alloy 310 | 69.92 | 4.95 | 2.10 | 5.46 | 7.02 | — | — | — | — | — | 2.00 | — | — | 8.55 | — |
| Alloy 311 | 70.12 | 4.95 | 2.10 | 4.61 | 7.67 | — | — | — | — | — | 2.00 | — | — | 8.55 | — |
| Alloy 312 | 70.27 | 4.95 | 2.10 | 4.61 | 7.02 | — | — | — | — | — | 2.50 | — | — | 8.55 | — |
| Alloy 313 | 69.91 | 5.24 | 2.10 | 5.04 | 7.35 | — | — | — | — | — | 2.25 | — | — | 8.11 | — |
| Alloy 314 | 68.40 | 4.95 | 2.10 | 6.98 | 7.02 | — | — | — | — | — | 2.00 | — | — | 8.55 | — |
| Alloy 315 | 69.29 | 4.95 | 2.10 | 6.09 | 7.02 | — | — | — | — | — | 2.00 | — | — | 8.55 | — |
| Alloy 316 | 70.20 | 4.95 | 2.10 | 5.18 | 7.02 | — | — | — | — | — | 2.00 | — | — | 8.55 | — |
| Alloy 317 | 70.79 | 4.95 | 2.10 | 6.09 | 5.52 | — | — | — | — | — | 2.00 | — | — | 8.55 | — |
| Alloy 318 | 72.29 | 4.95 | 2.10 | 6.09 | 4.02 | — | — | — | — | — | 2.00 | — | — | 8.55 | — |
| Alloy 319 | 73.79 | 4.95 | 2.10 | 6.09 | 2.52 | — | — | — | — | — | 2.00 | — | — | 8.55 | — |
| Alloy 320 | 68.29 | 5.95 | 2.10 | 6.09 | 7.02 | — | — | — | — | — | 2.00 | — | — | 8.55 | — |
| Alloy 321 | 70.29 | 3.95 | 2.10 | 6.09 | 7.02 | — | — | — | — | — | 2.00 | — | — | 8.55 | — |
| Alloy 322 | 70.30 | 4.95 | 2.10 | 5.50 | 6.60 | — | — | — | — | — | 2.00 | — | — | 8.55 | — |
| Alloy 323 | 71.29 | 4.95 | 2.10 | 6.09 | 7.02 | — | — | — | — | — | 2.00 | — | — | 6.55 | — |
| Alloy 324 | 67.29 | 4.95 | 2.10 | 6.09 | 7.02 | — | — | — | — | — | 2.00 | — | — | 10.55 | — |
| Alloy 325 | 70.29 | 4.95 | 2.10 | 6.09 | 7.02 | — | — | — | — | — | 1.00 | — | — | 8.55 | — |
| Alloy 326 | 71.29 | 4.95 | 2.10 | 6.09 | 7.02 | — | — | — | — | — | — | — | — | 8.55 | — |
| Alloy 327 | 68.54 | 4.95 | 2.10 | 6.09 | 7.02 | — | — | — | 0.75 | — | 2.00 | — | — | 8.55 | — |
| Alloy 328 | 68.29 | 4.95 | 2.10 | 6.09 | 7.02 | — | — | — | 1.00 | — | 2.00 | — | — | 8.55 | — |
| Alloy 329 | 68.79 | 4.95 | 2.10 | 6.09 | 7.02 | — | — | — | 0.75 | — | 1.00 | — | — | 9.30 | — |
| Alloy 330 | 72.79 | 4.95 | 2.10 | 6.09 | 4.02 | — | — | — | — | — | 1.50 | — | — | 8.55 | — |
| Alloy 331 | 71.79 | 5.95 | 2.10 | 6.09 | 4.02 | — | — | — | — | — | 1.50 | — | — | 8.55 | — |
| Alloy 332 | 72.42 | 4.95 | 2.10 | 6.09 | 4.02 | — | — | — | — | — | 1.50 | — | — | 8.92 | — |
| Alloy 333 | 71.42 | 5.95 | 2.10 | 6.09 | 4.02 | — | — | — | — | — | 1.50 | — | — | 8.92 | — |
| Alloy 334 | 70.42 | 6.95 | 2.10 | 6.09 | 4.02 | — | — | — | — | — | 1.50 | — | — | 8.92 | — |
| Alloy 335 | 70.80 | 4.95 | 2.10 | 5.50 | 6.60 | — | — | — | — | — | 1.50 | — | — | 8.55 | — |
| Alloy 336 | 69.80 | 5.95 | 2.10 | 5.50 | 6.60 | — | — | — | — | — | 1.50 | — | — | 8.55 | — |
| Alloy 337 | 70.43 | 4.95 | 2.10 | 5.50 | 6.60 | — | — | — | — | — | 1.50 | — | — | 8.92 | — |
| Alloy 338 | 69.43 | 5.95 | 2.10 | 5.50 | 6.60 | — | — | — | — | — | 1.50 | — | — | 8.92 | — |
| Alloy 339 | 68.43 | 6.95 | 2.10 | 5.50 | 6.60 | — | — | — | — | — | 1.50 | — | — | 8.92 | — |
| Alloy 340 | 71.79 | 4.95 | 2.10 | 6.09 | 7.02 | — | — | — | — | — | 1.50 | — | — | 6.55 | — |
| Alloy 341 | 72.29 | 4.95 | 2.10 | 6.09 | 7.02 | — | — | — | — | — | 2.00 | — | — | 5.55 | — |
| Alloy 342 | 73.29 | 4.95 | 2.10 | 6.09 | 7.02 | — | — | — | — | — | 2.00 | — | — | 4.55 | — |

The atomic percent of Fe present may therefore be 48.0, 48.1, 48.2, 48.3, 48.4, 48.5, 48.6, 48.7, 48.8, 48.9, 49.0, 49.1, 49.2, 49.3, 49.4, 49.5, 49.6, 49.7, 49.8, 49.9, 50.0, 50.1, 50.2, 50.3, 50.4, 50.5, 50.6, 50.7, 50.8, 50.9, 51.0, 51.1, 51.2, 51.3, 51.4, 51.5, 51.6, 51.7, 51.8, 51.9, 52.0, 52.1, 52.2, 52.3, 52.4, 52.5, 52.6, 52.7, 52.8, 52.9, 53.0, 53.1, 53.2, 53.3, 53.4, 53.5, 53.6, 53.7, 54.8, 53.9, 53.0 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, 59.0, 59.1, 59.2, 59.3, 59.4, 59.5, 59.6, 59.7, 59.8, 59.9, 60.0, 60.1, 60.2, 60.3, 60.4, 60.5, 60.6, 60.7, 60.8, 60.9 61.0, 61.1, 61.2, 61.3, 61.4, 61.5, 61.6, 61.7, 61.8, 61.9, 62.0, 62.1, 62.2, 62.3, 62.4, 62.5, 62.6, 62.7, 62.8, 62.9, 63.0, 63.1, 63.2, 63.3, 63.4, 63.5, 63.6, 63.7, 63.8, 63.9, 64.0, 64.1, 64.2, 64.3, 64.4, 64.5, 64.6, 64.7, 64.8, 64.9, 65.0, 65.1, 65.2, 65.3, 65.4, 65.5, 65.6, 65.7, 65.8, 65.9, 66.0, 66.1, 66.2, 66.3, 66.4, 66.5, 66.6, 66.7, 66.8, 66.9, 67.0, 67.1, 67.2, 67.3, 67.4, 67.5, 67.6, 67.7, 67.8, 67.9, 68.0, 68.1, 68.2, 68.3, 68.4, 68.5, 68.6, 68.7, 68.8, 68.9, 69.0, 69.1, 69.2, 69.3, 69.4, 69.5, 69.6, 69.7, 69.8, 69.9, 70.0, 70.1, 70.2, 70.3, 70.4, 70.5, 70.6, 70.7, 70.8, 70.9, 71.0, 71.1, 71.2, 71.3, 71.4, 71.5, 71.6, 71.7, 71.8, 71.9, 72.0, 72.1, 72.2, 72.3, 72.4, 72.5, 72.6, 72.7, 72.8, 72.9, 73.0, 73.1, 73.2, 73.3, 73.4, 73.5, 73.6, 73.7, 73.8, 73.9, 74.0, 74.1, 74.2, 74.3, 74.4, 74.5, 74.6, 74.7, 74.8, 74.9, 75.0, 75.1, 75.2, 75.3, 75.4, 75.5, 75.6, 75.7, 75.8, 75.9, 76.0, 76.1, 76.2, 76.3, 76.4, 76.5, 76.6, 76.7, 76.8, 76.9, 77.0, 77.1, 77.2, 77.3, 77.4, 77.5, 77.6, 77.7, 77.8, 77.9, 78.0, 78.1, 78.2, 78.3, 78.4, 78.5, 78.6, 78.7, 78.8, 78.9, 79, 79.1, 79.2, 79.3, 79.4, 79.5, 79.6, 79.7, 79.8, 79.9, 80.0, 80.1, 80.2, 80.3, 80.4, 80.5, 80.6, 80.7, 80.8, 80.9, 81.0.

The atomic percent of B may therefore be 2.0, 2.1, 2.2, 2.3, 2.4, 2.5, 2.6 2.7, 2.8, 2.9 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0.

The atomic percent of Si may therefore be 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0.

The atomic percent of Cu may therefore be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6 2.7, 2.8, 2.9 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0.

The atomic ratio of Mn may therefore be 0.1, 0.2, 0.3, 0.4, 0.5, 0.6, 0.7, 0.8, 0.9 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, 21.0.

The atomic ratio of Ni may therefore be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6 2.7, 2.8, 2.9 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0.

The atomic ratio of Cr as an optional element, if present, may therefore be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7., 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, 21.0, 21.1, 21.2, 21.3, 21.4, 21.5, 21.6, 21.7, 21.8, 21.9, 22.0, 22.1, 22.2, 22.3, 22.4, 22.5, 22.6, 22.7, 22.8, 22.9, 23.0, 23.1, 23.2, 23.3, 23.4, 23.5, 23.6, 23.7, 23.8, 23.9, 24.0, 24.1, 24.2, 24.3, 24.4, 24.5, 24.6, 24.7, 24.8, 24.9, 25.0, 25.1, 25.2, 25.3, 25.4, 25.5, 25.6, 25.7, 25.8, 25.9, 26.0, 26.1, 26.2, 26.3, 26.4, 26.5, 26.6, 26.7, 26.8, 26.9, 27, 27.1, 27.2, 27.3, 27.4, 27.5, 27.6, 27.7, 27.8, 27.9, 28.0, 28.1, 28.2, 28.3, 28.4, 28.5, 28.6, 28.7, 28.8, 28.9, 29.0, 29.1, 29.2, 29.3, 29.4, 29.5, 29.6, 29.7, 29.8, 29.9, 30.0, 30.1, 30.2, 30.3, 30.4, 30.5, 30.6, 30.7, 30.8, 30.9, 31.0, 31.1, 31.2, 31.3, 31.4, 31.5, 31.6, 31.7, 31.8, 31.9, 32.0.

Case Example #1

Warm Formability of Class 2 Stainless Alloy

The study was performed to evaluate warm formability of the alloys described in this application at elevated temperatures. In a case of plate production by Twin Roll Casting or Thin Slab Casting, utilized alloys should have good formability to be processed by hot rolling as a step at production process. Moreover, hot forming ability is a critical feature of the high strength alloys in terms of their usage for part production with different configuration by such methods as hot pressing, hot stamping, etc.

Using ferroadditives and other readily commercially available constituents, 35 g commercial purity (CP) feedstocks for Alloy 82 representing Class 2 steel were weighed out according to the atomic ratio provided in Table 2. The feedstock material was then placed into the copper hearth of an arc-melting system. The feedstock was arc-melted into an ingot using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plates with thickness of 1.8 mm.

Resultant plate from the Alloy 82 was subjected to a HIP cycle at 1150° C. using an American Isostatic Press Model 645 machine with a molybdenum furnace with furnace chamber size of 4 inch diameter by 5 inch height. The plates were heated at 10° C./min until the target temperature and were exposed to an isostatic pressure of 30 ksi for 1 hour. Heat treatment at 850° C. for 1 hour was applied after HIP cycle. Tensile specimens with a gage length of 12 mm and a width of 3 mm were cut from the treated plate.

Figure 11:
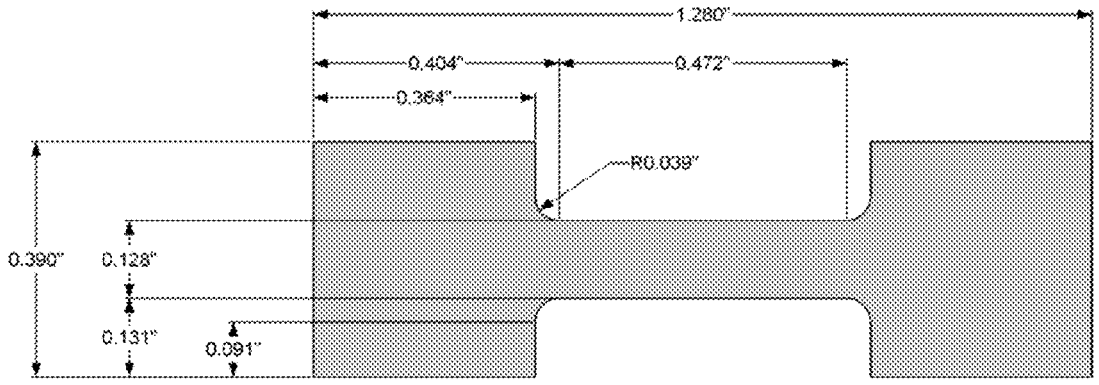
FIG. 11 NanoSteel sized R&D specimen geometry that was modified to increase the grip sections to 9.5 mm in order to accommodate ⅛" grip pinholes.

The tensile measurements were done with testing parameters listed in Table 3 at temperatures specified in Table 4. The NanoSteel R&D specimen geometry (shown in FIG. 11) was modified by enlarging the grip section to accommodate for pinholes required for elevated temperature tensile testing. The modified grip section of the sample is 9.5 mm (⅜"). In Table 5, a summary of the tensile test results including total tensile elongation (strain), yield stress, and ultimate tensile strength are shown for the treated plate from Alloy 82. Room temperature tensile property ranges for the same alloy after the same treatments are listed for comparison. As can be seen, ductility in high strength alloy is twice higher at 700° C. and reaches up to 92% when tested at 800° C. demonstrating high warm forming ability of the alloy. Warm temperature ductility of the alloys strongly depends on alloy chemistry, thermal mechanical treatment parameters and testing temperature.

TABLE 3

Tensile Testing Parameters

| Parameter | Value |
|---|---|
| Testing Standard | ASTM E21-09 |
| Soak time | 5 to 30 minutes |
| Test Speed | 0.020 in/min |

TABLE 4

Testing Temperatures

| Parameter Set | Testing Temperature (° C.) | Homologous Temperature |
|---|---|---|
| 1 | 700 | 0.65 |
| 2 | 800 | 0.71 |

TABLE 5

Tensile Test Results for Alloy 82

| Test Temperature [° C.] | Elongation at Fracture [%] | Yield Strength [GPa] | UTS [MPa] |
|---|---|---|---|
| 25 | 27 | 455.9 | 1256 |
| 700 | 56 | 281.3 | 386.1 |
| | 58 | 287.5 | 388.2 |
| 800 | 66 | 156.5 | 206.2 |
| | 92 | 179.3 | 215.1 |

Case Example #2

Warm Formability of Class 2 Non-Stainless Alloy

Using ferroadditives and other readily commercially available constituents, 35 g commercial purity (CP) feedstocks for Alloy 213 representing Class 2 steel were weighed out according to the atomic ratio provided in Table 2. The feedstock material was then placed into the copper hearth of an arc-melting system. The feedstock was arc-melted into an ingot using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plates with thickness of 1.8 mm.

Resultant plate from the Alloy 213 was subjected to a HIP cycle at 1125° C. using an American Isostatic Press Model 645 machine with a molybdenum furnace with furnace chamber size of 4 inch diameter by 5 inch height. The plates were heated at 10° C./min until the target temperature and were exposed to an isostatic pressure of 30 ksi for 1 hour. Tensile specimens with NanoSteel R&D specimen geometry (FIG. 11) were cut from the treated plate.

Figure 12:
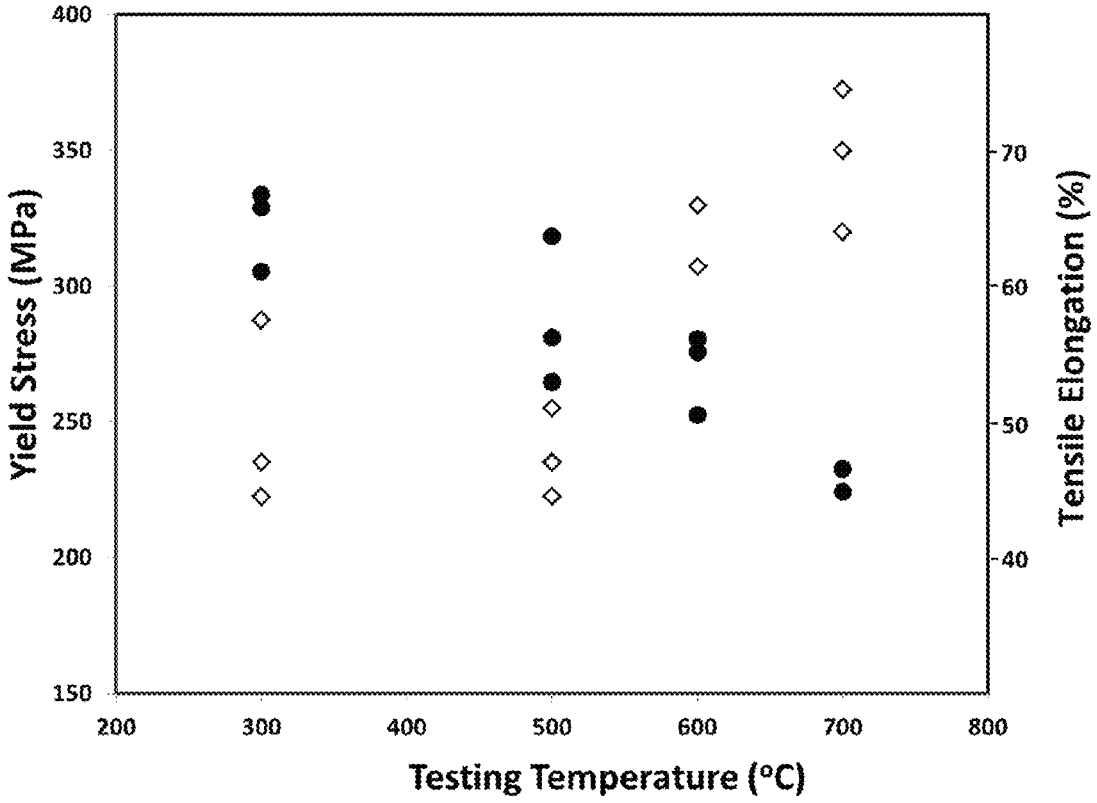
FIG. 12 Temperature dependence of yield stress and tensile elongation in Alloy 213.

The tensile measurements were done with testing parameters listed in Table 6 at temperatures specified in Table 7. In Table 8, a summary of the tensile test results including total tensile elongation (strain), yield stress, and ultimate tensile strength are shown for the treated plate from Alloy 213. Room temperature tensile property ranges for the same alloy after the same treatments are listed for comparison. As can be seen, this alloy shows high ductility up to 74% when tested at 700° C. demonstrating high warm forming ability. Temperature dependence of yield stress and tensile elongation is illustrated on FIG. 12. Warm temperature ductility of the alloys strongly depends on alloy chemistry, thermal mechanical treatment parameters and testing temperature.

TABLE 6

Tensile Testing Parameters

| Parameter | Value |
|---|---|
| Test Standard | ASTM E21-09 |
| Test atmosphere | Ambient |
| Soak time | 20-30 minutes |
| Strain rate | 0.424/minute |
| Displacement rate (Control parameter) | 0.020 in/min (0.508 mm/min) |

TABLE 7

Testing Temperatures

| Parameter Set | Testing Temperature (° C.) | Homologous Temperature (K/K) |
|---|---|---|
| 1 | 300 | 0.4 |
| 2 | 500 | 0.54 |
| 3 | 600 | 0.61 |
| 4 | 700 | 0.68 |

TABLE 8

Test Results for Alloy 213

| Test Temperature [° C.] | Elongation [%] | Yield Strength [MPa] | UTS [MPa] |
|---|---|---|---|
| 20 | 11.7 | 383 | 1321 |
| 300 | 47.0 | 329 | 692 |
| | 44.5 | 305 | 674 |
| | 57.5 | 334 | 698 |
| 500 | 47.0 | 319 | 596 |
| | 44.5 | 281 | 599 |
| | 51.0 | 265 | 562 |
| 600 | 66.0 | 276 | 479 |
| | 66.0 | 281 | 464 |
| | 61.5 | 252 | 460 |
| 700 | 64.0 | 232 | 297 |
| | 70.0 | 232 | 285 |
| | 74.5 | 224 | 280 |

Case Example #3

Warm Formability of Class 3 Alloy

The study was performed to evaluate warm formability of the alloys described in this application at elevated temperatures. In a case of plate production by Twin Roll Casting or Thin Slab Casting, utilized alloys should have good formability to be processed by hot rolling as a step at production process. Moreover, hot forming ability is a critical feature of the high strength alloys in terms of their usage for part production with different configuration by such methods as hot pressing, hot stamping, etc.

Using high purity elements, 35 g alloy feedstocks of the Alloy 36 representing Class 3 steel were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plates with thickness of 1.8 mm.

Resultant plate from the Alloy 36 was subjected to a HIP cycle at 1100° C. using an American Isostatic Press Model 645 machine with a molybdenum furnace with furnace chamber size of 4 inch diameter by 5 inch height. The plates were heated at 10° C./min until the target temperature and were exposed to an isostatic pressure of 30 ksi for 1 hour. Heat treatment at 850° C. for 1 hour was applied after HIP cycle. Tensile specimens with NanoSteel R&D specimen geometry (FIG. 11) were cut from the treated plate.

Figure 13:
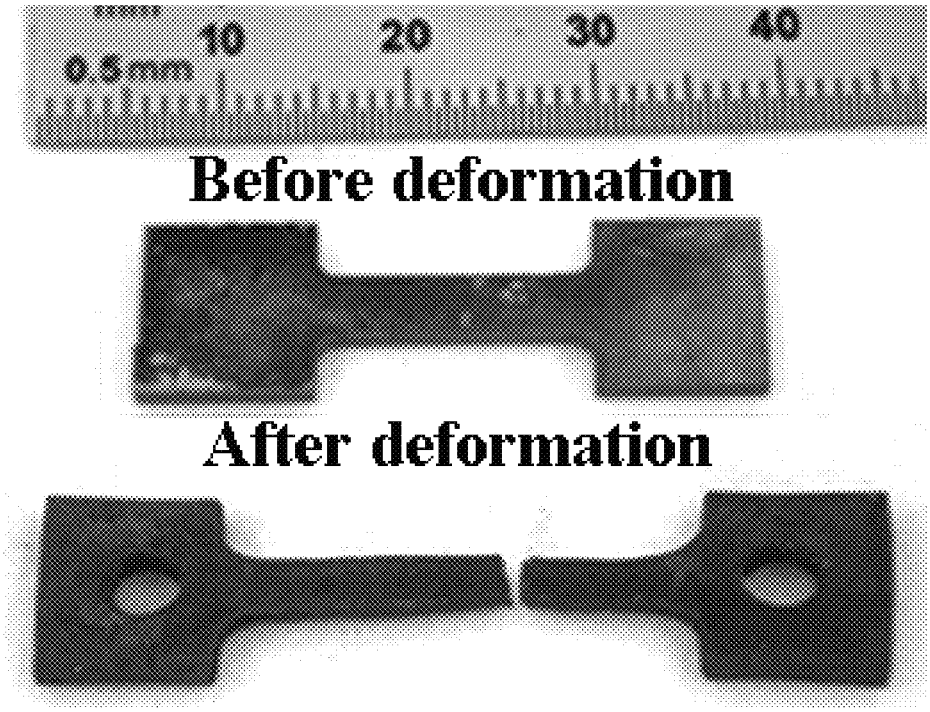
FIG. 13 View of the Class 3 Alloy 36 specimen after HIP cycle and heat treatment before and after deformation to 57.5%.

The tensile measurements were done at strain rate of 0.001 $s^{-1}$ at 700° C. In Table 9, a summary of the tensile test results including total tensile elongation (strain), yield stress, and ultimate tensile strength are shown for the treated plate from Alloy 36. Room temperature tensile property ranges for the same alloy after the same treatments are listed for comparison. As can be seen, high strength alloys with ultimate strength up to 1650 MPa at room temperature show high ductility up to 88.5% when tested at 700° C. demonstrating high warm forming ability. Warm temperature ductility of the alloys strongly depends on alloy chemistry, thermal mechanical treatment parameters and testing temperature. An example of tested specimen is shown in FIG. 13.

TABLE 9

Tensile Test Results for Alloy 36

| Alloy | Test Temperature [° C.] | Elongation at Fracture [%] | Yield Stress [MPa] | Ultimate Strength [MPa] |
|---|---|---|---|---|
| Alloy 36 | RT | 3.4-7.4 | 850-1145 | 1525-1653 |
| | 700 | 57.5 | 66.9 | 157.9 |
| | | 88.5 | 68.3 | 157.9 |

Case Example #4

Warm Formability of Commercial Sheet from Class 2 Alloy

Figure 14:
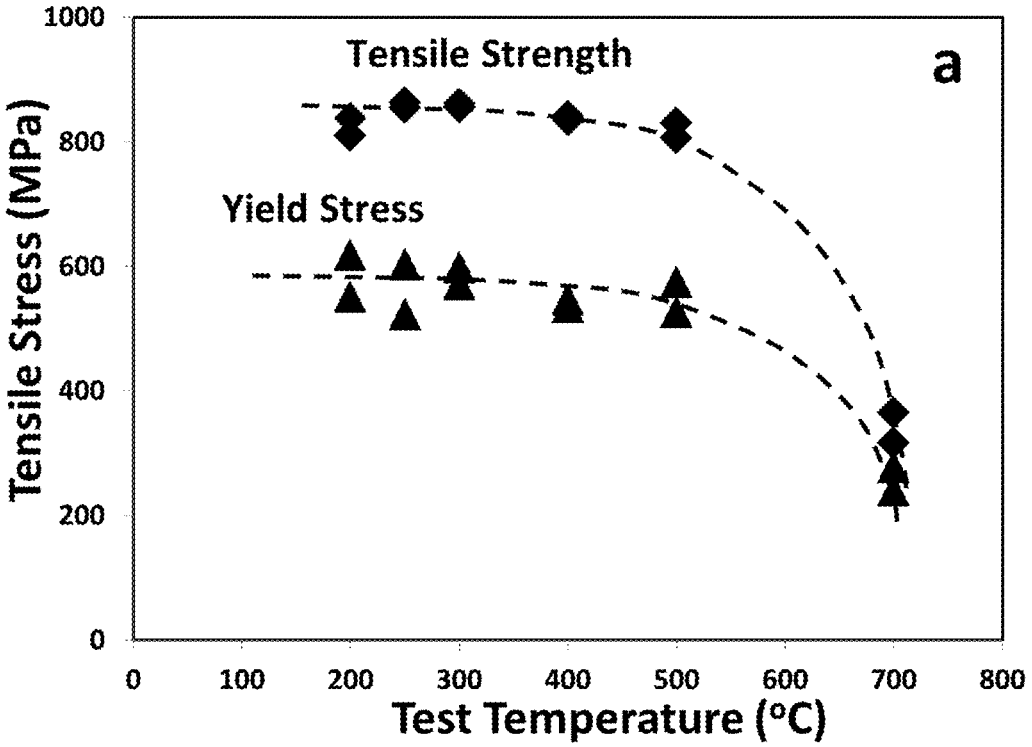
FIG. 14 Tensile strength, yield stress and tensile elongation as a function of testing temperature in commercial sheet from Alloy 82.
Figure 14:
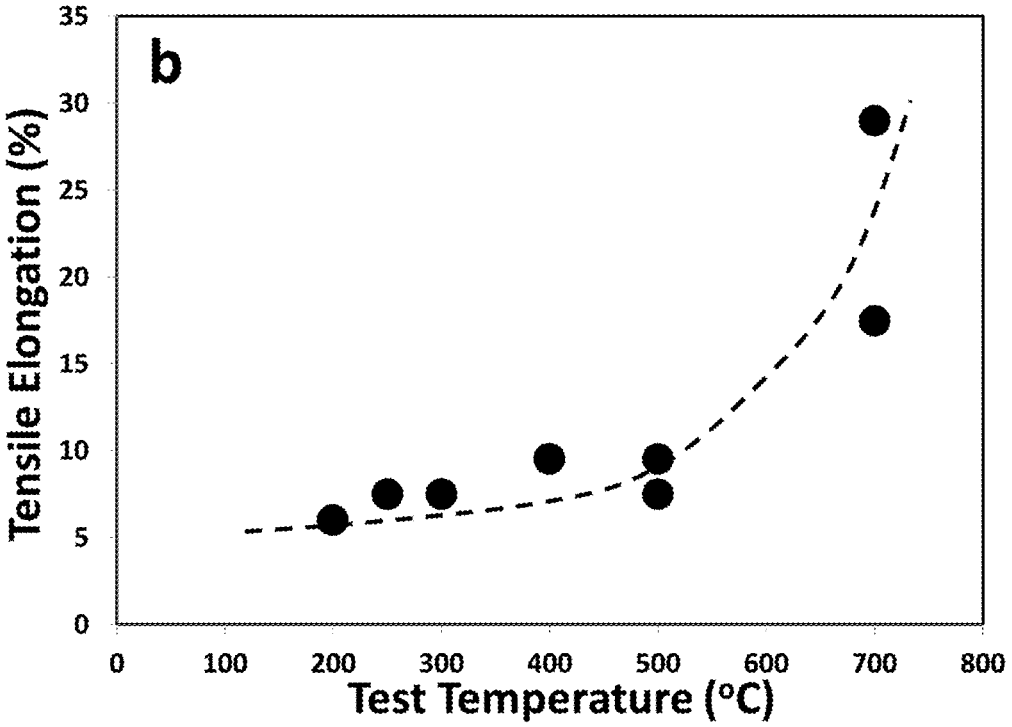

Alloy 82 was utilized for commercial sheet production by Thin Strip casting with in-line hot rolling that was done at ~1050° C. to ~9% reduction. The condition of the sheet material is not optimized (partial transformation into Nano-Modal structure due to low temperature and reduction at in-line rolling). Tensile specimens with NanoSteel R&D specimen geometry (FIG. 11) were cut from the produced sheet. The tensile measurements were done with testing parameters listed in Table 10 at temperatures specified in Table 11. In Table 12, a summary of the tensile test results including total tensile elongation (strain), yield stress, and ultimate tensile strength are shown for the produced sheet from Alloy 82. Temperature dependence of strength characteristics and tensile elongation is shown in FIG. 14. As it can be seen, that despite only partial transformation into NanoModal structure at in-line hot rolling, the ductility of up to 30% can be achieved at 700° C. Even higher warm forming ability is expected in the sheet with full transformation.

TABLE 10

Tensile Testing Parameters

| Parameter | Value |
|---|---|
| Testing Standard | ASTM E21-09 |
| Soak time | 5 to 30 minutes |
| Test Speed 1 | 0.020 in/min |
| Test Speed 2 | 0.005 in/in-min, 0.05 in/in-min |

TABLE 11

Testing Temperatures

| Parameter Set | Testing Temperature (° C.) | Homologous Temperature (K/K) |
|---|---|---|
| 1 | 400 | 0.45 |
| 2 | 450 | 0.48 |
| 3 | 500 | 0.51 |
| 4 | 550 | 0.55 |
| 5 | 600 | 0.58 |
| 6 | 650 | 0.61 |
| 7 | 700 | 0.65 |

TABLE 12

Test Results

| Test Temperature [° C.] | Elongation at Fracture [%] | Yield Strength [GPa] | UTS [MPa] |
|---|---|---|---|
| 400 | 4.66 | 375.8 | 672.9 |
| | 3.58 | 366.8 | 633.6 |
| 450 | 5.69 | 353.0 | 664.0 |
| | 4.31 | 380.6 | 649.5 |
| 500 | 4.03 | 386.1 | 605.4 |
| | 2.95 | 389.6 | 602.6 |
| 550 | 3.69 | 413.7 | 600.5 |
| | 4.28 | 464.7 | 610.2 |
| 600 | 5.90 | 408.2 | 596.4 |
| | 4.92 | 389.6 | 583.3 |
| 650 | 10.1 | 301.3 | 492.3 |
| | 4.47 | 260.6 | 447.5 |
| 700 | 13.4 | 326.1 | 402.7 |
| | 18.7 | 337.2 | 402.0 |
| 750 | 32.93 | 180.6 | 313.0 |
| | 28.8 | 217.2 | 301.3 |
| 800 | 46.0 | 163.4 | 214.4 |
| | 42.5 | 160.0 | 207.5 |

What is claimed is:

1. A method comprising:

supplying a metal alloy comprising Fe at 48.0 to 81.0 atomic percent, B at 2.0to 8.0atomic percent, Si at 4.0 to 14.0 atomic percent, Cu at 0.1 to 6.0 atomic percent and Mn at 10.5 to 21.0 atomic percent and optionally Ni present at 0.1 to 16.0 atomic percent;

melting said alloy and solidifying, without quenching, to form a matrix grain size of 500 nm to 20,000 nm and a boride grain size of 25 nm to 500 nm;

mechanical stressing, or heating and mechanical stressing said alloy form at least one of the following:

(a) matrix grain size of 500 nm to 20,000 nm, boride grains of 25 nm to 500 nm, precipitation grain size of 1 nm to 200 nm wherein said alloy indicates a yield strength of 400 MPa to 1300 MPa, tensile strength of 700 MPa to 1400 MPa and a tensile elongation of 10% to 50%;

(b) refined matrix grain size of 100 nm to 2000 nm, precipitation grain size of 1 nm to 200 nm, boride grain size of 200 nm to 2500 nm where the alloy has yield strength of 300 MPa to 800 MPa; and heating of the alloy (a) or alloy (b) at a temperature of 200° C. to 850° C. for a time period of up to 1 hour wherein upon cooling there is no eutectoid transformation.

2. The method of claim 1 wherein said alloy is formed into a selected shape.

3. The method of claim 1 wherein said alloy having said refined matrix grain size (b) is exposed to a stress that exceeds said yield strength of 300 MPa to 800 MPa wherein said refined matrix grain size remains at 100 nm to 2000 nm, said boride grain size remains at 200 nm to 2500 nm, said precipitation grain size remains at 1 nm to 200 nm wherein said alloy indicates a yield strength of 400 MPa to 1700 MPa, tensile strength of 800 MPa to 1800 MPa and an elongation of 5% to 40%.

4. The method of claim 3 wherein said alloy is formed into a selected shape.

5. The method of claim 1 including Cr at a level of up to 32 atomic percent.

6. The method of claim 1 including C, Al, Ti, V, Nb, Mo, Zr, W or Pd at a level of up to 10 atomic percent.

7. A method comprising:

(a) supplying a metal alloy comprising Fe at 48.0 to 81.0 atomic percent, B at 2.0 to 8.0 atomic percent, Si at 4.0 to 14.0 atomic percent, Cu at 0.1 to 6.0 atomic percent and at least one or more of Mn at 10.5 to 21.0 atomic percent and optionally Ni at 0.1 to 16.0 atomic percent;

(b) melting said alloy and solidifying, without quenching, to provide dendritic morphology and matrix grain size of 500 nm to 20,000 nm and boride grain size of 100 nm to 2500 nm;

(c) heat treating said alloy and forming lath structure including grains of 100 nm to 10,000 nm, boride grains of 100 nm to 2500 nm wherein said alloy has a yield strength of 300 MPa to 1400 MPa, tensile strength of 350 MPa to 1600 MPa and elongation of 0-12%;

(d) heat treating said alloy after step (c) and forming lamellae grains 100 nm to 10,000 nm thick, 0.1 microns to 5.0 microns in length and 100 nm to 1000 nm in width along with boride grains of 100 nm to 25000 nm and precipitation grains of 1.0 nm to 100 nm wherein said alloy indicates a yield strength of 350 MPa to 1400 MPa;

(e) wherein said alloy is heated a temperature of 200° C. to 850° C. for a time period of up to 1 hour and upon cooling there is no eutectoid transformation.

8. The method of claim 7 wherein the alloy formed in step (d) is stressed prior to step (e) and forms an alloy having grains of 100 nm to 5000 nm, boride grains of 100 nm to 2500 nm, precipitation grains of 1 nm to 100 nm and said alloy has a yield strength of 500 MPa to 1800 MPa, tensile strength of 1000 to 2000 MPa, and an elongation of 0.5% to 15%.

9. The method of claim 7 wherein said alloy is formed into a selected shape.

10. The method of claim 8 wherein said alloy is formed into a selected shape.

11. The method of claim 7 including Cr at a level of up to 32 atomic percent.

12. The method of claim 7 including C, Al, Ti, V, Nb, Mo, Zr, W or Pd at a level of up to 10 atomic percent.

* * * * *